US010649381B2

(12) United States Patent
Mitsui

(10) Patent No.: US 10,649,381 B2
(45) Date of Patent: May 12, 2020

(54) IMAGE FORMING APPARATUS AND FIXING DEVICE THAT CHANGE OPENING WIDTHS OF AIR BLOWING OPENINGS BY MOVING SHIELDING MEMBERS WITH RESPECT TO A LONGITUDINAL DIRECTION OF THE FIXING DEVICE

(71) Applicant: CANON KABUSHIKI KAISHA, Tokyo (JP)

(72) Inventor: Yuji Mitsui, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/136,373

(22) Filed: Sep. 20, 2018

(65) Prior Publication Data

US 2019/0086850 A1 Mar. 21, 2019

(30) Foreign Application Priority Data

Sep. 21, 2017 (JP) ..... 2017-181187
Jul. 10, 2018 (JP) ..... 2018-130867

(51) Int. Cl.
*G03G 15/20* (2006.01)
*G03G 15/00* (2006.01)
*G03G 21/20* (2006.01)

(52) U.S. Cl.
CPC ..... *G03G 15/5029* (2013.01); *G03G 15/2017* (2013.01); *G03G 15/2039* (2013.01); *G03G 15/2042* (2013.01); *G03G 21/206* (2013.01)

(58) Field of Classification Search
CPC ..... G03G 15/5029; G03G 15/2039
See application file for complete search history.

(56) References Cited

U.S. PATENT DOCUMENTS 9,081,340 B2 * 7/2015 Suzuki ..... G03G 21/206 399/69
2012/0148290 A1 * 6/2012 Asami ..... G03G 15/2042 399/92

(Continued)

FOREIGN PATENT DOCUMENTS

JP 2008-032903 A 2/2008
JP 2008-040235 A 2/2008

(Continued)

OTHER PUBLICATIONS

Extended European Search Report dated Feb. 1, 2019, issued in European Application No. 18193621.2.

*Primary Examiner* — G.M. A Hyder
(74) *Attorney, Agent, or Firm* — Venable LLP

(57) ABSTRACT

An image forming apparatus includes a fixing unit having a first shielding member configured to change an opening width of a first opening with respect to a longitudinal direction, a second shielding member configured to change an opening width of a second opening with respect to the longitudinal direction, and a controller that controls, on the basis of an output of a detector and size information of the recording material, the opening widths of the first opening and the second opening, so as to correspond to widths of non-passing portions of the recording material in the nip, by moving the first shielding member and the second shielding member in the longitudinal direction, respectively, when the recording material, having a size other than the maximum size, is inserted into the fixing unit.

20 Claims, 15 Drawing Sheets

(56) References Cited

U.S. PATENT DOCUMENTS

| | | | | |
|---|---|---|---|---|
| 2012/0308256 | A1 | 12/2012 | Suzuki | |
| 2013/0236202 | A1* | 9/2013 | Akiya | G03G 21/206 399/69 |

FOREIGN PATENT DOCUMENTS

| | | | |
|---|---|---|---|
| JP | 2010-249994 | A | 11/2010 |
| JP | 2012-252194 | A | 12/2012 |

* cited by examiner

IMAGE FORMING APPARATUS AND FIXING DEVICE THAT CHANGE OPENING WIDTHS OF AIR BLOWING OPENINGS BY MOVING SHIELDING MEMBERS WITH RESPECT TO A LONGITUDINAL DIRECTION OF THE FIXING DEVICE

This application claims the benefit of Japanese Patent Application No. 2017-181187, filed on Sep. 21, 2017, and Japanese Patent Application No. 2018-130867, filed on Jul. 10, 2018, which are hereby incorporated by reference herein in their entireties.

FIELD OF THE INVENTION AND RELATED ART

The present invention relates to an image forming apparatus and a fixing device that include an air blowing means for suppressing non-sheet-passing portion temperature rise.

In recent years, a copying machine and a printer that use an electrophotographic process have been used not only in a large office, but also by various users in a wide variety of markets, such as a small office and personal use. For that reason, as regards a recording material used in the copying machine and the printer, those having not only various kinds, but also various sizes, have been used.

Here, when small-width recording materials (small-size paper), which are narrower in width than maximum-size paper having a maximum width, are passed through the copying machine and the printer, and on which a toner image is fixable by a fixing device incorporated in the copying machine and the printer, are not continuously passed through the fixing device, a so-called non-sheet-passing portion temperature rise occurs. That is, due to a difference in heat consumption between a passing portion and a non-passing portion of the recording materials in the fixing device, a degree of temperature rise at the non-passing portion of the recording materials becomes large.

In order to avoid this phenomenon, a fixing device in which an air blowing port (opening), through which cooling air from a cooling fan blows out, is provided at each of non-sheet-passing portions, which are longitudinal end portions of a fixing member of the fixing device, and thus, the non-sheet-passing-portions are cooled, has been proposed. Further, a fixing device in which a widthwise size of an air blowing port (opening width) is made variable so as to be compatible with sizes of various recording materials with respect to a widthwise direction has also been proposed.

For example, a fixing device in which, in addition to a shutter for adjusting a width of an air blowing part (opening width) depending on a width of a recording material used, the shutter is provided with a temperature detecting means in order to detect a temperature rise at a boundary between a non-sheet-passing portion and a sheet-passing portion, and in which ON/OFF control of a cooling fan is carried out depending on a detection temperature, has been proposed (Japanese Laid-Open Patent Application No. 2008-032903). Thus, a constitution in which both end portions, which are non-sheet-passing portions, are cooled correspondingly to a detection result of a widthwise size of the recording material used for printing is employed.

In addition, an image forming apparatus in which shift detection of a recording material is carried out, and then, opening and closing of shutters are performed has been proposed (Japanese Laid-Open Patent Application No. 2012-252194). Specifically, a sub-thermistor for detecting a temperature of a fixing (device) heater is provided at each of end portions within a maximum-size-sheet-passing region with respect to a widthwise direction of a recording material. During shift sheet passing, a shutter, close to a sub-thermistor, opposite from a sub-thermistor detecting a heater temperature, which continuously increases and which exceeds a predetermined temperature, is closed and thereafter, a cooling fan is driven. As a result, a constitution in which safety at a non-sheet-passing portion is enhanced, and, on the other hand, a fixing property is not impaired is presented. A constitution is employed in which, although a shift of the recording material can be indirectly detected by detecting non-sheet-passing portion temperature rise, an opening width with respect to a widthwise direction of the recording material is divided between one end portion and the other end portion depending on a degree of the non-sheet-passing portion temperature rise, and thus, the non-sheet-passing portion is cooled.

In these constitutions, with respect to the widthwise direction of the recording material, in a case in which a center of the recording material is deviated from a position (ideal position) in which the recording material center overlaps (coincides) with a center of the fixing device, on one side of longitudinal end portions of the fixing device (on the same side as a side on which the recording material is shifted), the cooling air is also blown to a region through which the recording material passes. As a result a new problem occurs such that a lowering in fixing property occurs at a portion at which the cooling air is blown thereto. On the other hand, on the other side of the longitudinal end portions of the fixing member (on a side opposite from the side on which the recording material is shifted with respect to the widthwise direction of the recording material), the cooling air can be blown to an entirety of the non-sheet-passing portion with respect to the longitudinal direction, so that a problem occurs in that a suppressing effect of the non-sheet-passing portion temperature rise lowers.

Thus, a temperature of a fixing nip through which the recording material passes is not uniformized, and, therefore, it would be considered that a method is employed in which a gap between recording materials (i.e., a recording material feeding interval) is increased in view of the lowering in fixing property, and a method is employed in which a recording material feeding speed itself is slowed and temperature rise of the fixing device is awaited. In this case, however, a problem occurs such that productivity per unit time lowers.

SUMMARY OF THE INVENTION

A principal object of the present invention is to provide an image forming apparatus and a fixing device that are capable of suppressing occurrences of non-sheet-passing portion temperature rise and improper fixing without lowering productivity even in the case in which a feeding position of a recording material is deviated with respect to a widthwise direction of the recording material.

According to one aspect, the present invention provides an image forming apparatus comprising an image forming portion configured to form toner images on recording materials having a first size and a second size smaller than the first size with respect to a longitudinal direction, and a fixing unit configured to form a nip in which the toner image is fixed by nipping and feeding the recording material, wherein the fixing unit is capable of fixing the toner image on the recording material having the first size, which is a maximum fixable size of the recording material, wherein the fixing unit includes an elongated heater extending in the longitudinal direction perpendicular to a feeding direction of the recording material, air blowing means configured to blow air toward one end portion and the other end portion of the heater with respect to the longitudinal direction when the recording material having the second size is inserted into the fixing unit, a first opening through which air blown from the air blowing means toward the one end portion of the heater passes, a first shielding member configured to change an opening width of the first opening with respect to the longitudinal direction, a second opening through which air blown from the air blowing means toward the other end portion of the heater passes, a second shielding member configured to change an opening width of the second opening with respect to the longitudinal direction, detecting means configured to detect a deviation amount of the recording material in a widthwise direction with respect to the feeding direction of the recording material, and a controller configured to control, on the basis of an output of the detecting means and size information of the recording material, the opening widths of the first and second openings so as to be different from each other by moving the first and second shielding members, respectively.

According to another aspect, the present invention provides an image forming apparatus comprising an image forming portion configured to form toner images on recording materials having a first size and a second size smaller than the first size with respect to a longitudinal direction, and a fixing unit configured to form a nip in which the toner image is fixed by nipping and feeding the recording material, wherein the fixing unit is capable of fixing the toner image on the recording material having the first size as a maximum fixable size of the recording material, wherein the fixing unit includes an elongated heater extending in the longitudinal direction perpendicular to a feeding direction of the recording material, air blowing means configured to blow air toward one end portion and the other end portion of the heater with respect to the longitudinal direction when the recording material having the second size is inserted into the fixing unit, a first opening through which air blown from the air blowing means toward the one end portion of the heater passes, a first shielding member configured to change an opening width of the first opening with respect to the longitudinal direction, a second opening through which air blown from the air blowing means toward the other end portion of the heater passes, a second shielding member configured to change an opening width of the second opening with respect to the longitudinal direction, detecting means configured to detect temperatures of the one and the other end portions of the heater, and a controller configured to control, on the basis of an output of the detecting means and size information of the recording material, the opening widths of the first and second openings so as to be different from each other by moving the first and second shielding members, respectively.

According to yet another aspect, the present invention provides a fixing device for fixing toner images on recording materials in a nip by nipping and feeding the recording materials in the nip, wherein the recording materials have a first size and a second size smaller than the first size with respect to a longitudinal direction, the first size being a maximum size of the recording material on which the toner image is fixable by the fixing device, the fixing device comprising an elongated heater extending in the longitudinal direction perpendicular to a feeding direction of the recording material, air blowing means configured to blow air toward one end portion and the other end portion of the heater with respect to the longitudinal direction when the recording material having the second size is inserted into the fixing device, a first opening through which air blown from the air blowing means toward the one end portion of the heater passes, a first shielding member configured to change an opening width of the first opening with respect to the longitudinal direction, a second opening through which air blown from the air blowing means toward the other end portion of the heater passes, a second shielding member configured to change an opening width of the second opening with respect to the longitudinal direction, and detecting means configured to detect a deviation amount of the recording material in a widthwise direction with respect to the feeding direction of the recording material, wherein the opening widths of the first and second openings are made different from each other by moving the first and second shielding members, respectively, on the basis of an output of the detecting means and size information of the recording material.

According to still another aspect, the present invention provides a fixing device for fixing toner images on recording materials in a nip by nipping and feeding the recording materials in the nip, wherein the recording materials have a first size and a second size smaller than the first size with respect to a longitudinal direction, the first size being a maximum size of the recording material on which the toner image is fixable by the fixing device, the fixing device comprising an elongated heater extending in the longitudinal direction perpendicular to a feeding direction of the recording material, air blowing means configured to blow air toward one end portion and the other end portion of the heater with respect to the longitudinal direction when the recording material having the second size is inserted into the fixing device, a first opening through which air blown from the air blowing means toward the one end portion of the heater passes, a first shielding member configured to change an opening width of the first opening with respect to the longitudinal direction, a second opening through which air blown from the air blowing means toward the other end portion of the heater passes, a second shielding member configured to change an opening width of the second opening with respect to the longitudinal direction, and detecting means configured to detect temperatures of the one and the other end portions of the heater, wherein the opening widths of the first and second openings are made different from each other by moving the first and second shielding members, respectively, on the basis of an output of the detecting means and size information of the recording material.

Further features of the present invention will become apparent from the following description of exemplary embodiments with reference to the attached drawings.

Figure 3:
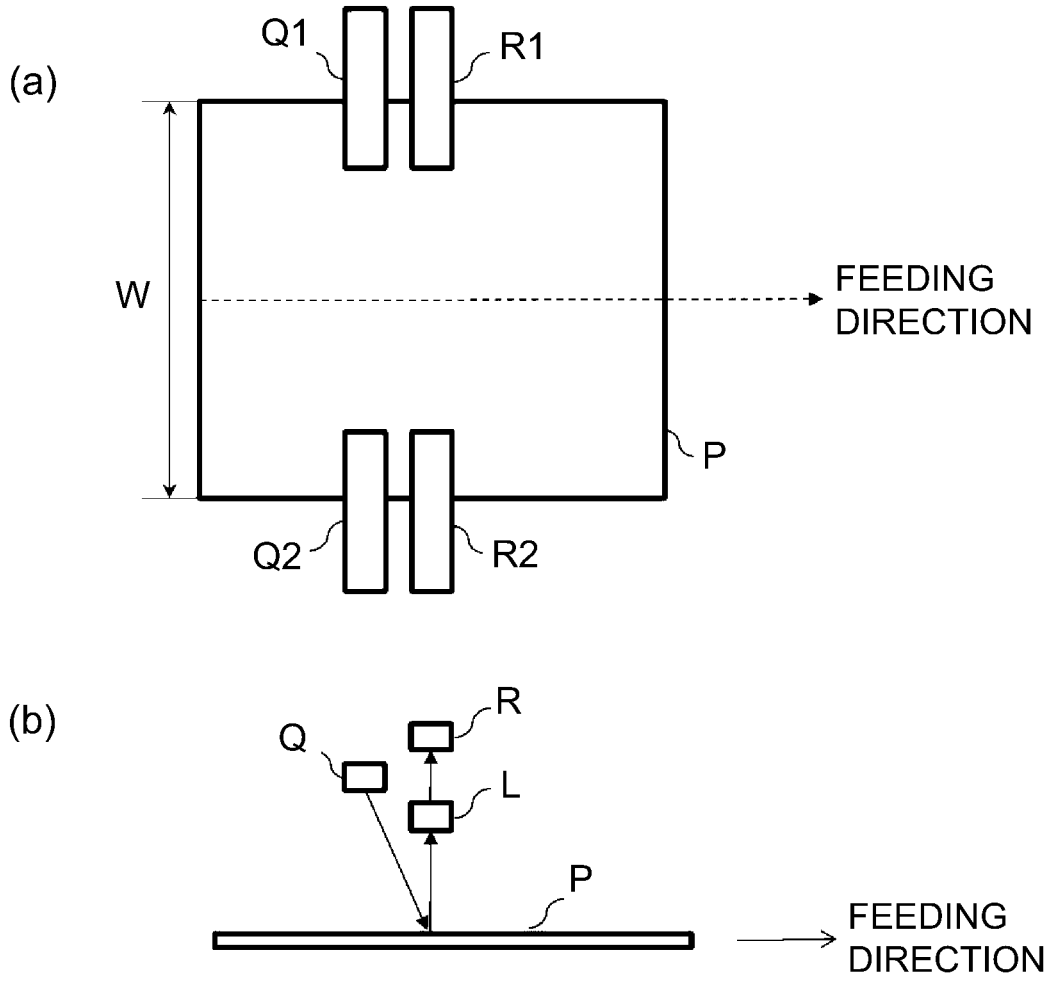

Parts (a) and (b) of FIG. 3 are schematic views for illustrating a paper (sheet) position detecting means.

Figure 4:
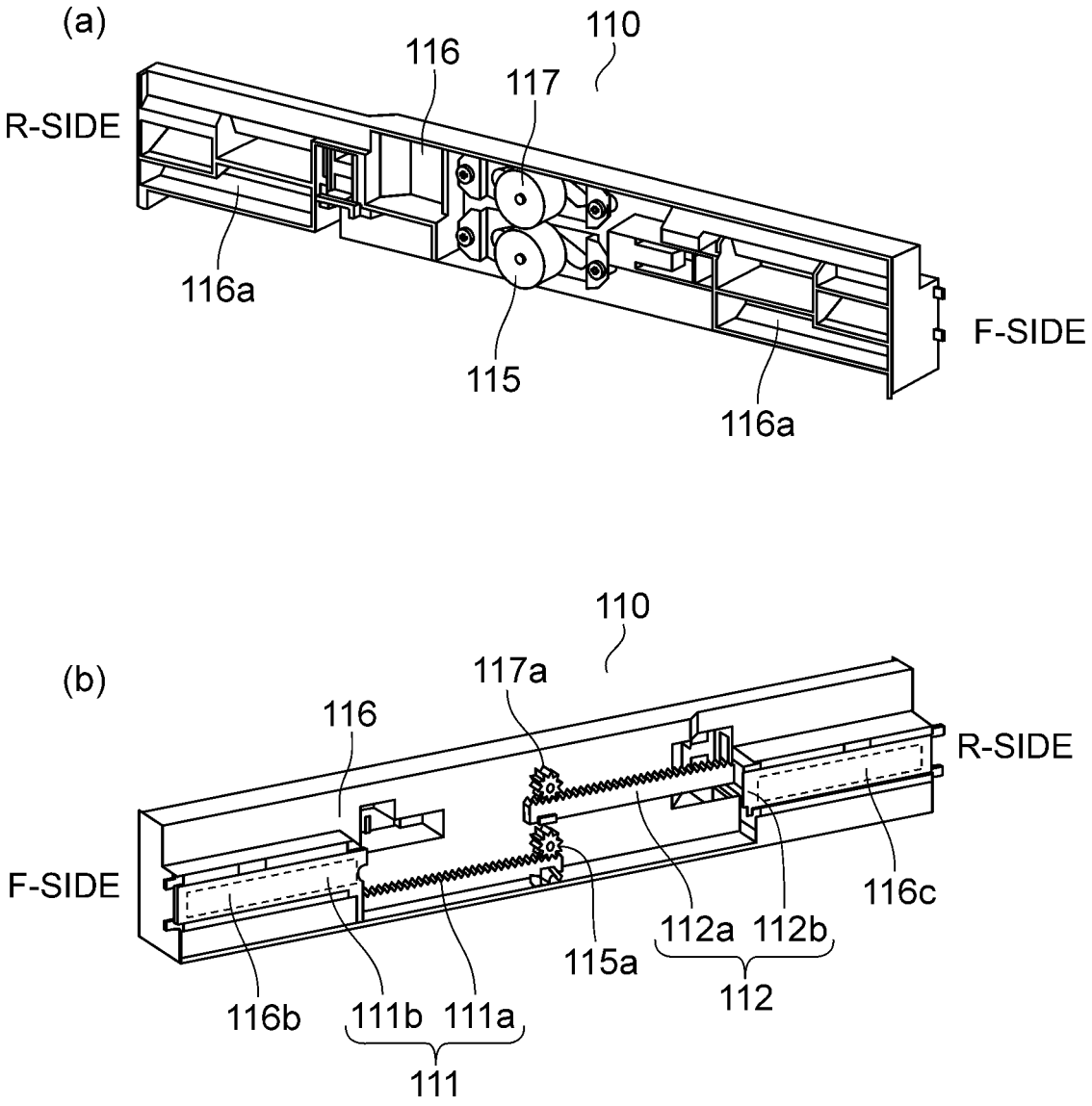

Parts (a) and (b) of FIG. 4 are perspective views of a shielding unit.

Figure 5:
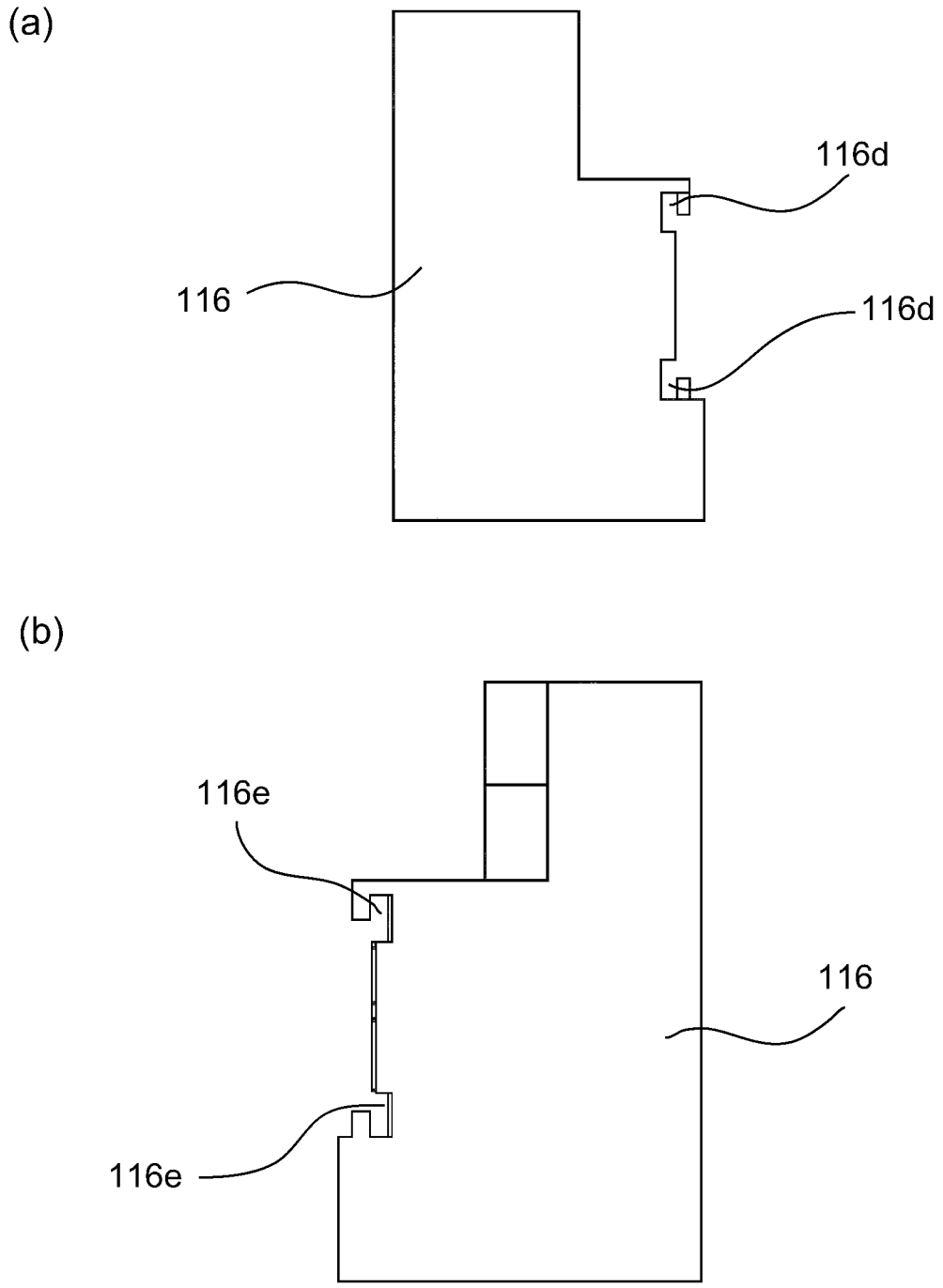

Parts (a) and (b) of FIG. 5 are schematic views of an outer appearance of the shielding unit.

Figure 6:
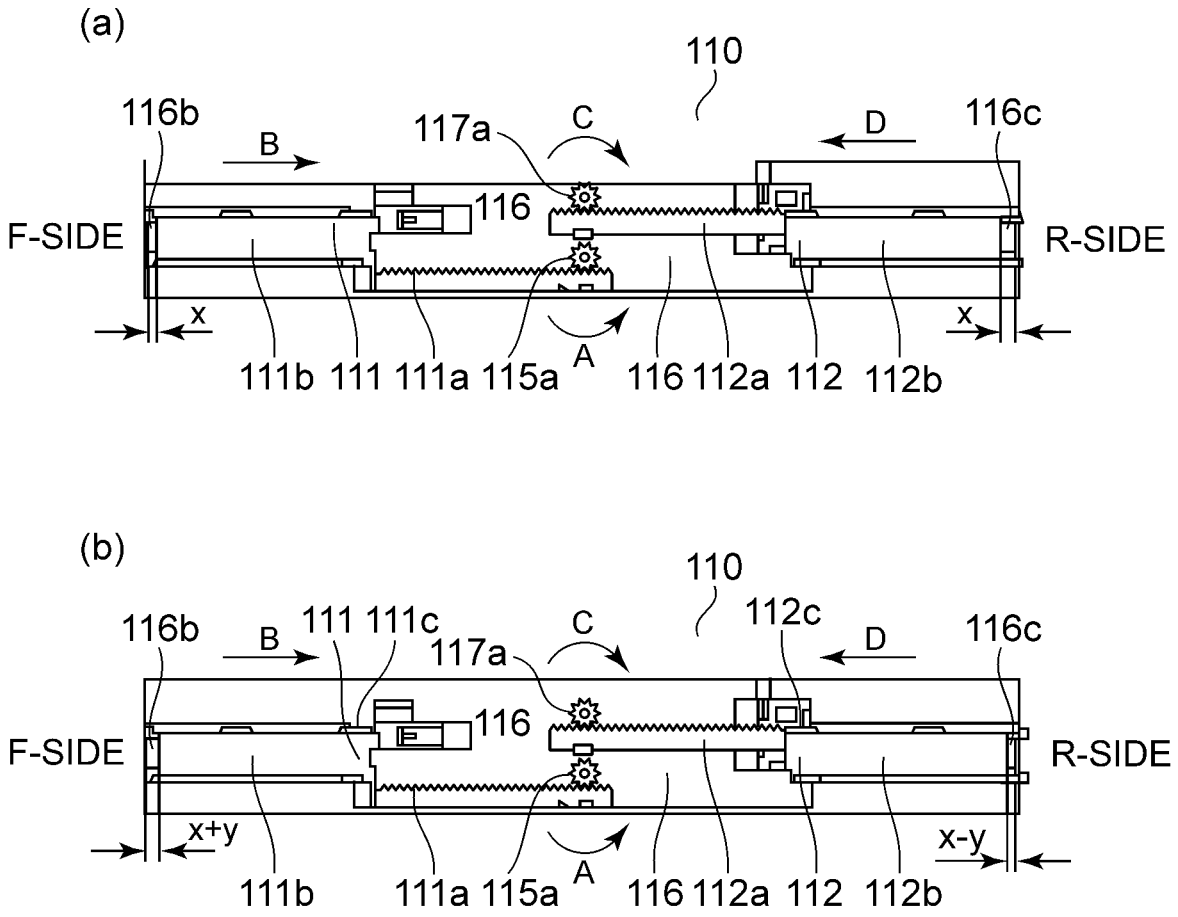

Parts (a) and (b) of FIG. 6 are side views of a shielding frame.

Figure 7:
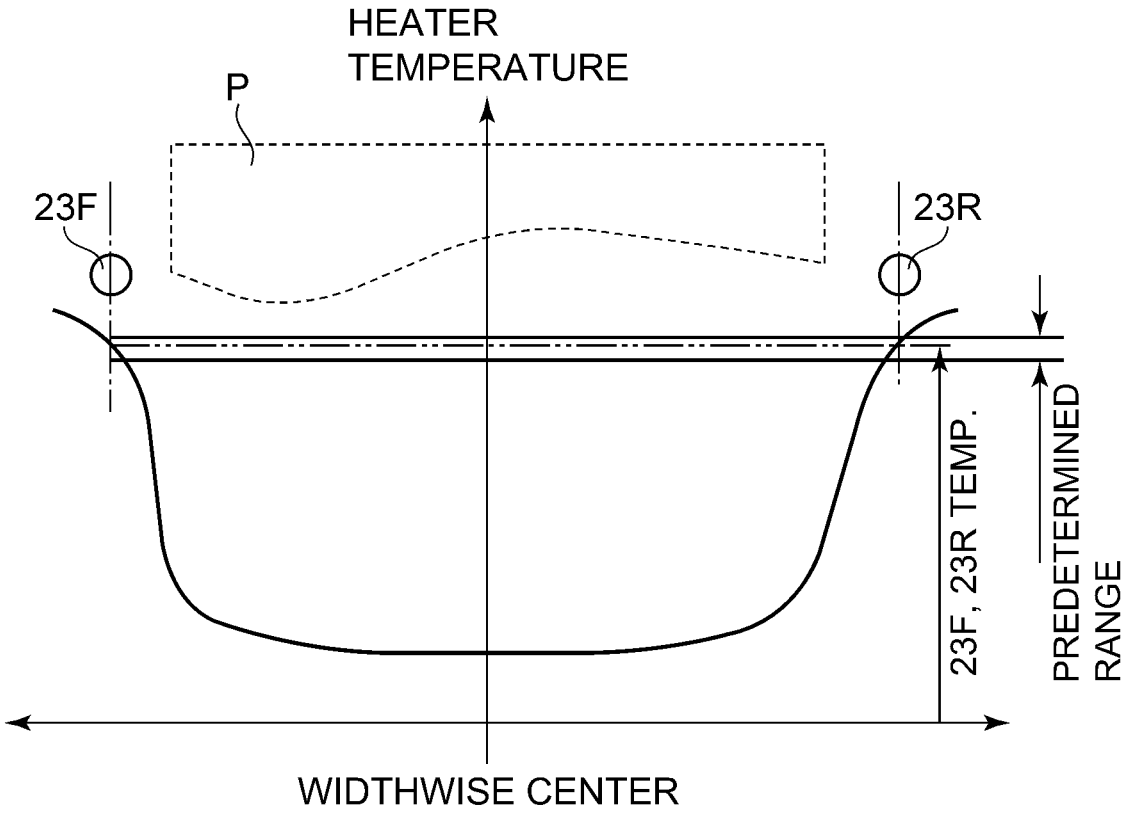

FIG. 7 is a temperature curve of a heater (within a tolerance).

Figure 8:
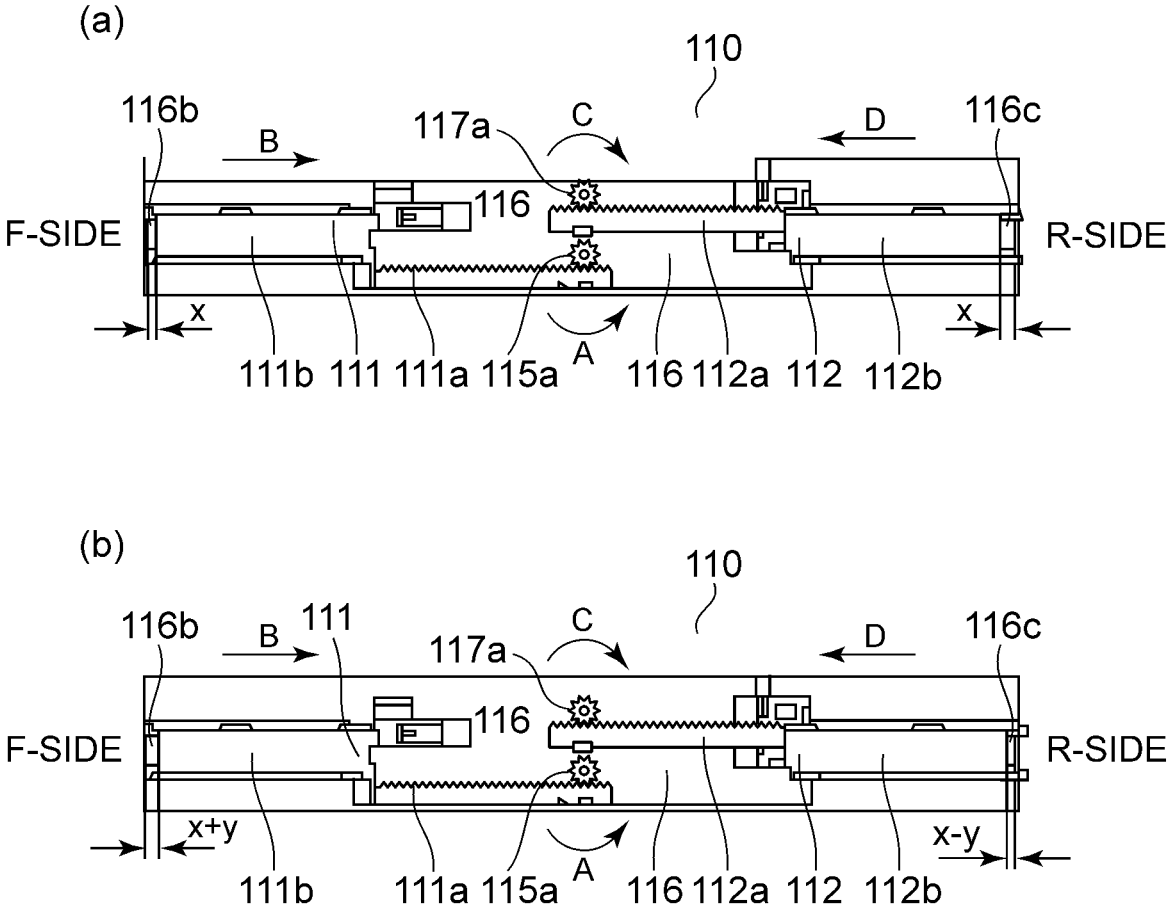

Parts (a) and (b) of FIG. 8 are operation state views of the shielding unit.

Figure 9:
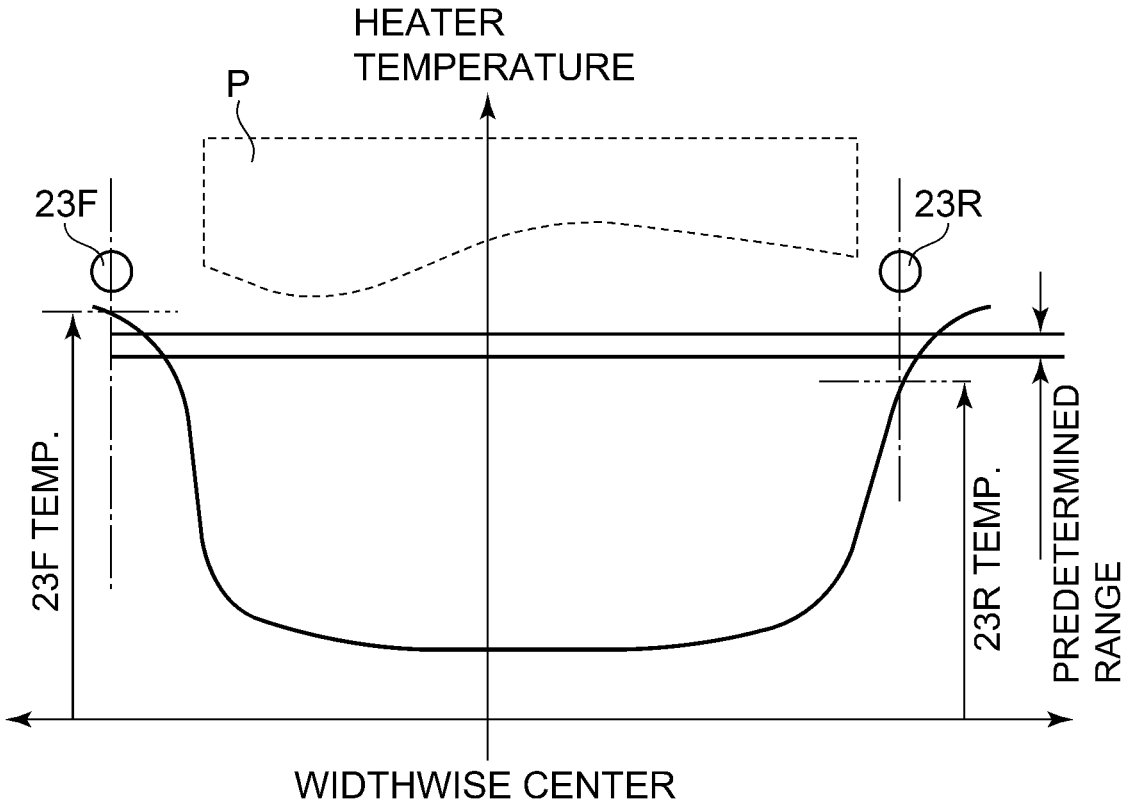

FIG. 9 is a temperature curve of the heater (out of the tolerance: rear side shift).

Figure 10:
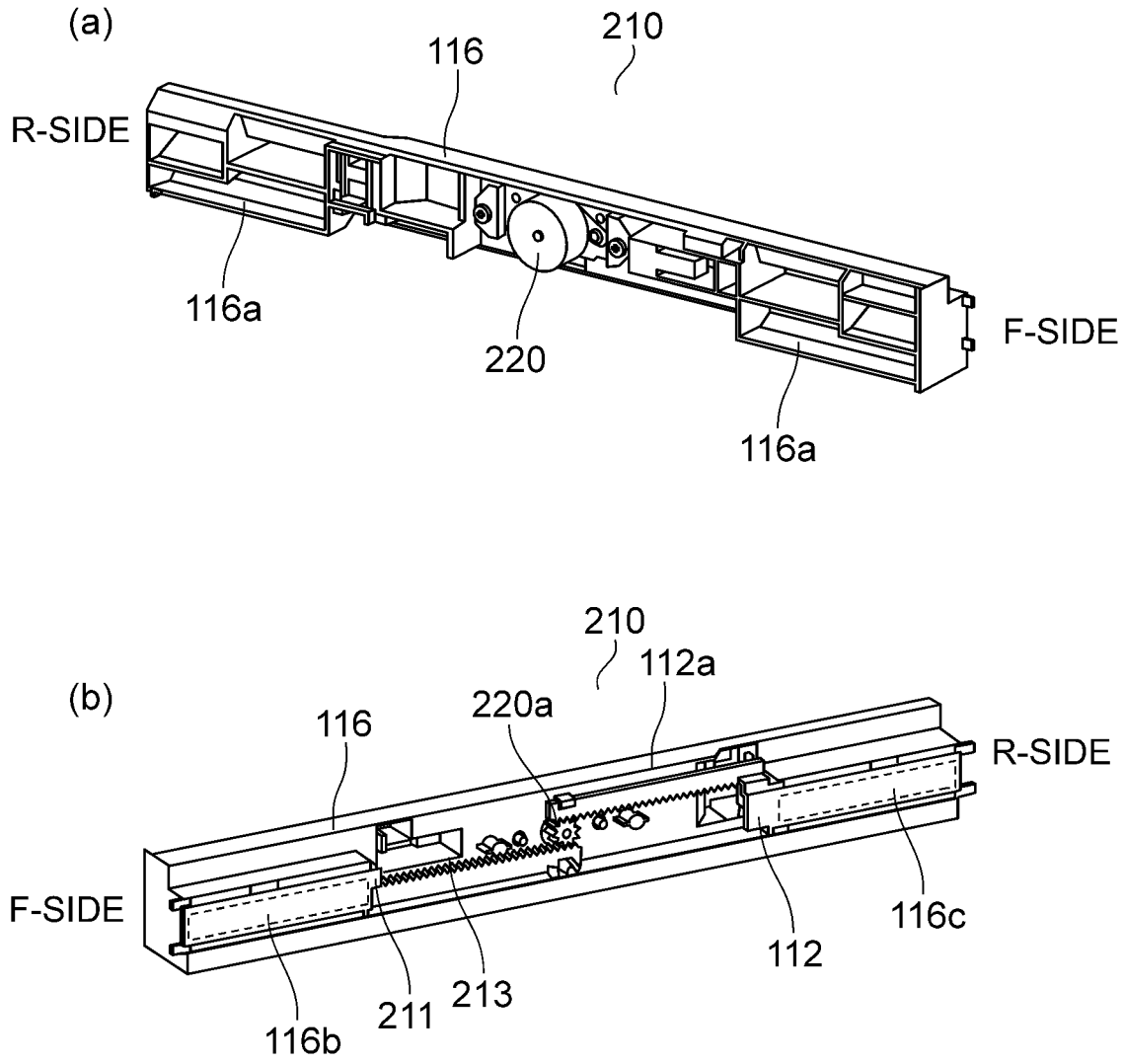

Parts (a) and (b) of FIG. 10 are perspective views of a shielding unit.

Figure 11:
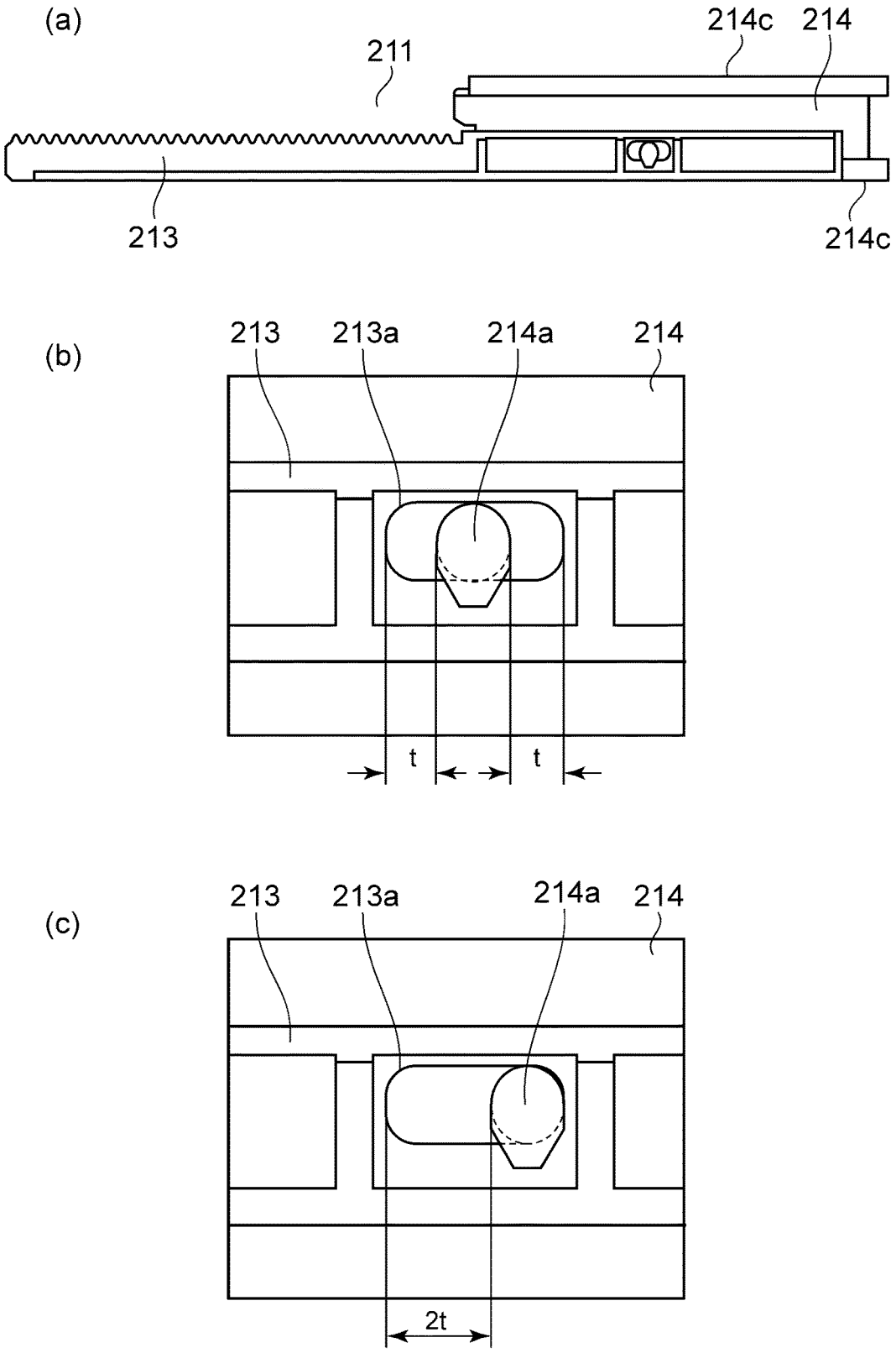

Parts (a), (b), and (c) of FIG. 11 are schematic views of an outer appearance of a shielding member.

Figure 12:
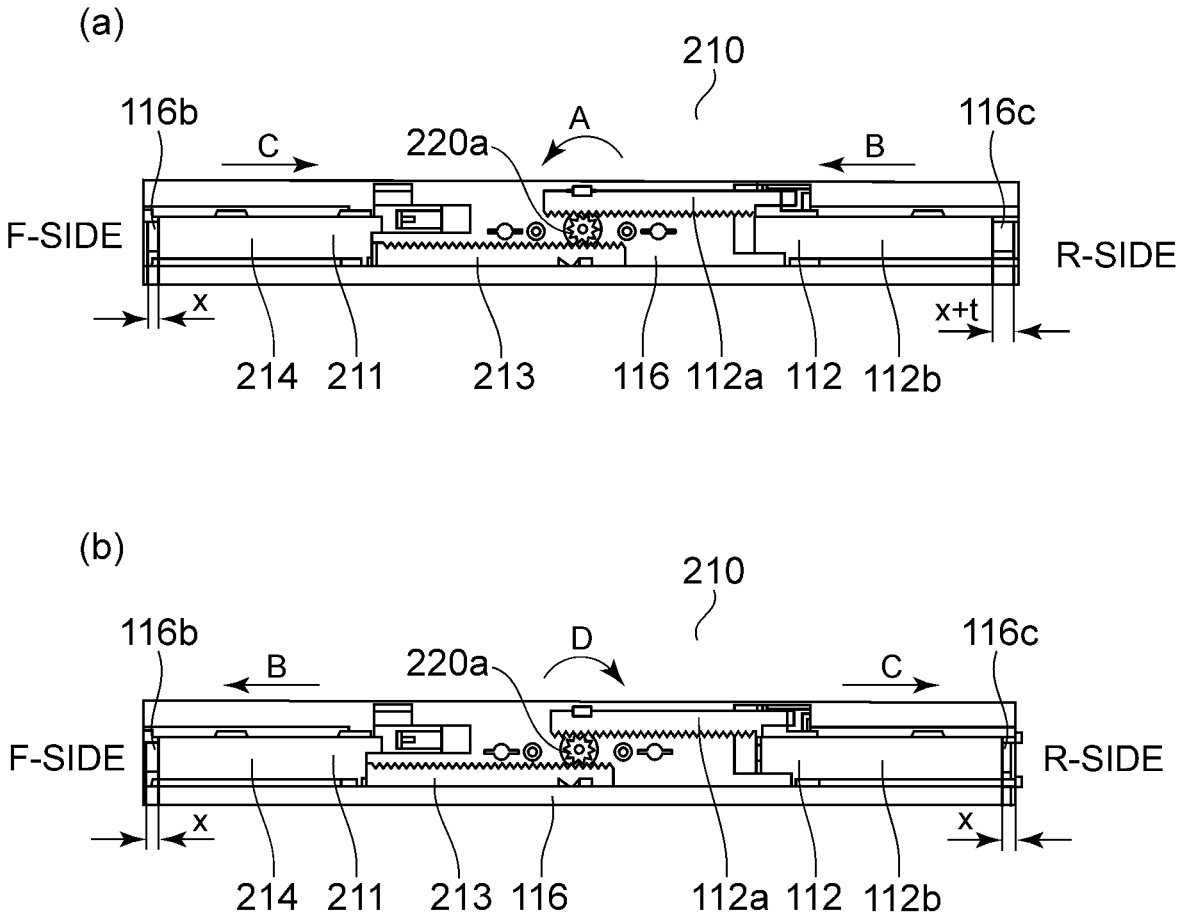

Parts (a) and (b) of FIG. 12 are operation state views of a shielding unit (in the case in which a recording material is not shifted with respect to a widthwise direction of the recording material).

Figure 13:
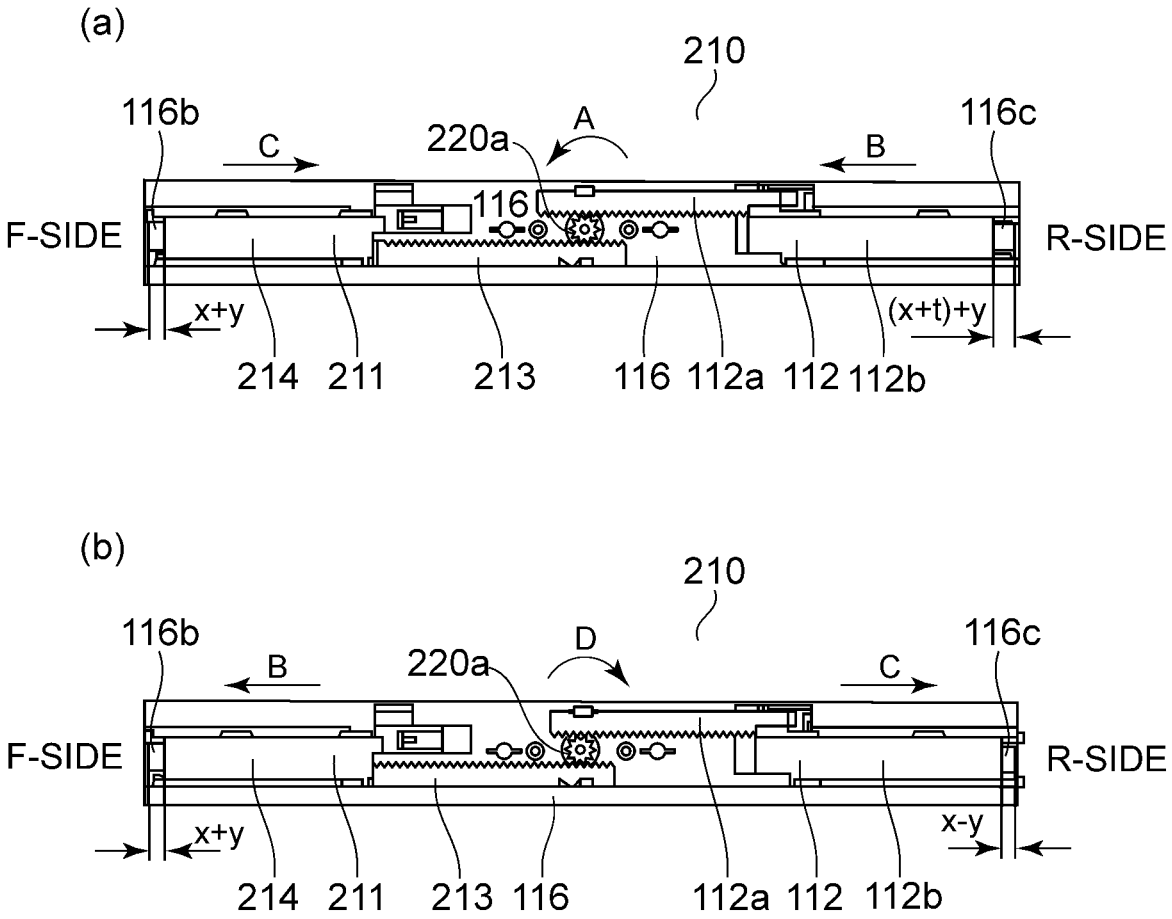

Parts (a) and (b) of FIG. 13 are operation state views of the shielding unit (in the case in which the recording material is shifted toward the rear side).

Figure 14:
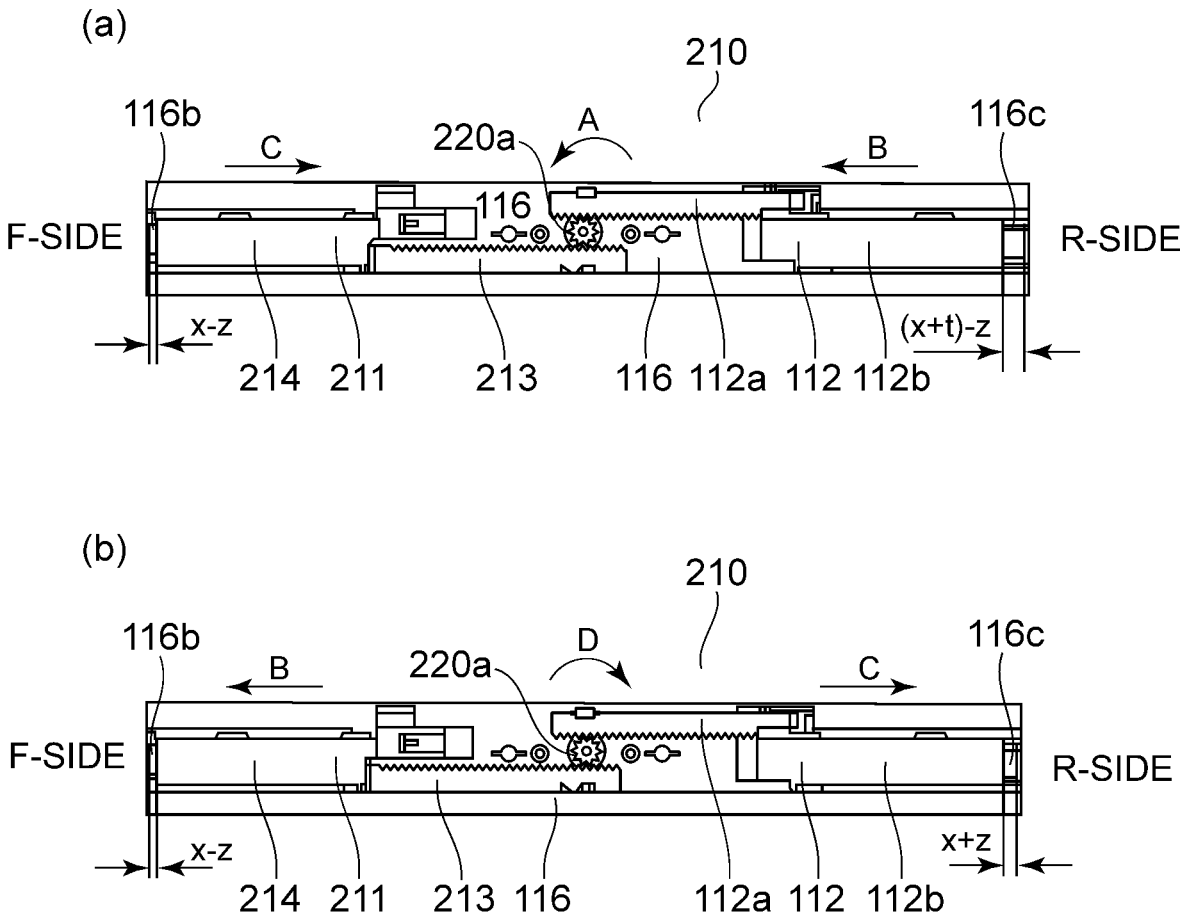

Parts (a) and (b) of FIG. 14 are operation state views of the shielding unit (in the case in which the recording material is shifted toward a front side).

Figure 15:
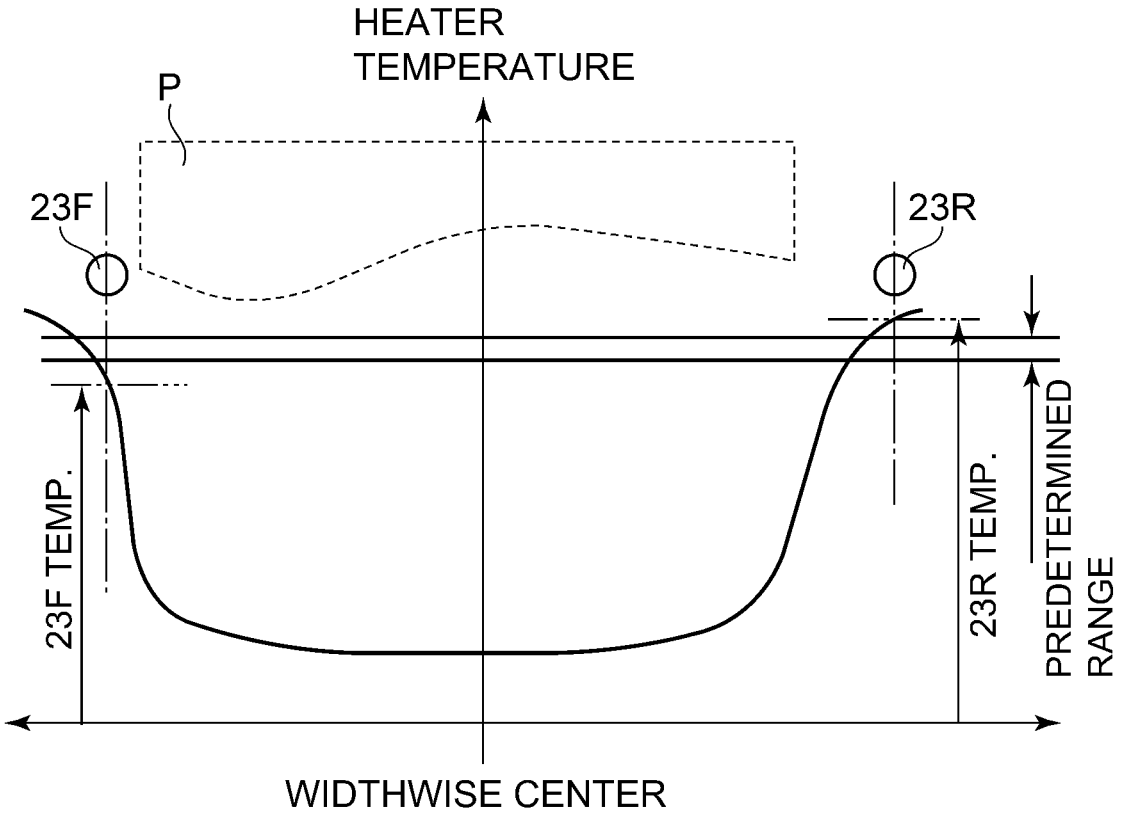

FIG. 15 is a temperature curve of a heater 24.

BRIEF DESCRIPTION OF THE DRAWINGS

Embodiments of the present invention will be specifically described with reference to the drawings.

First Embodiment

Image Forming Apparatus

Figure 1:
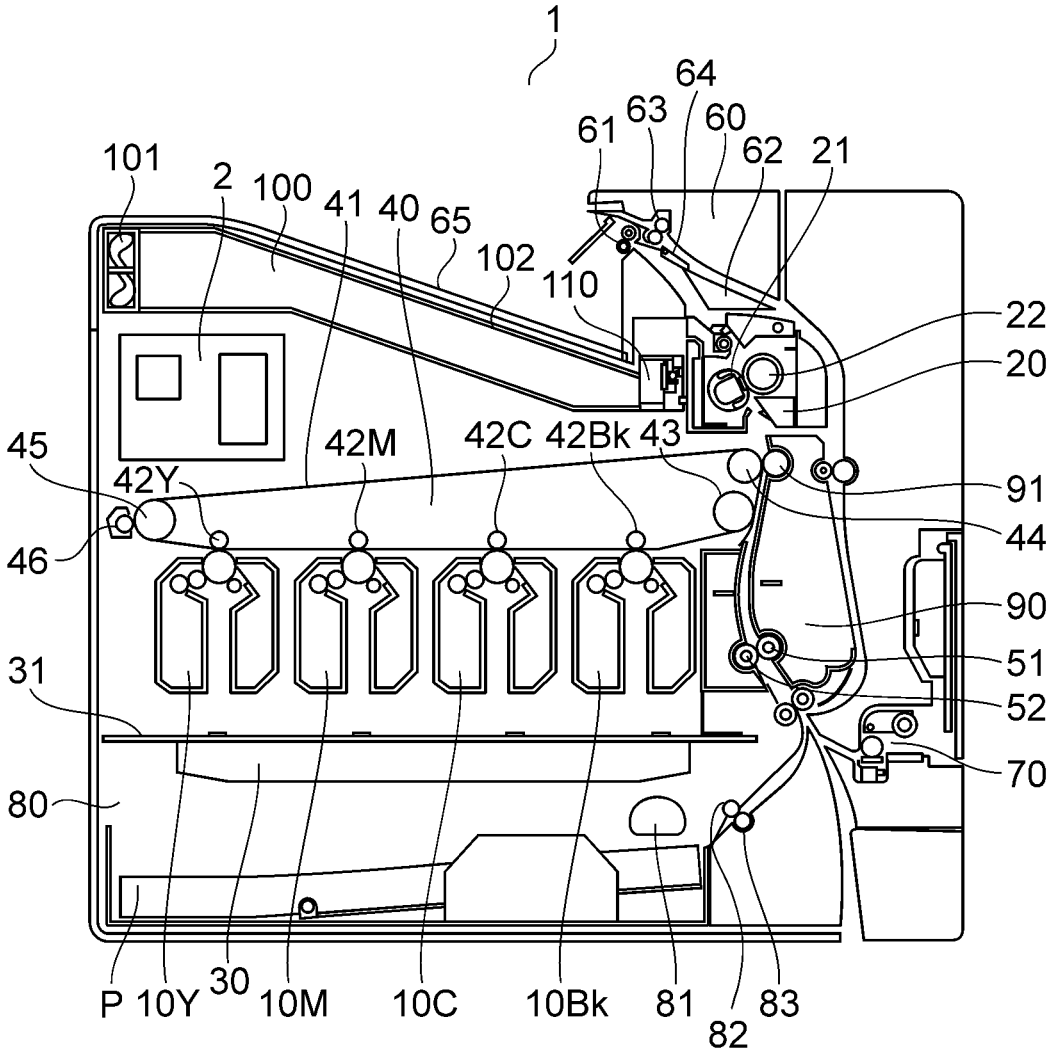
FIG. 1 is a longitudinal sectional view showing a general structure of an image forming apparatus.

An outline of a general structure of an image forming apparatus 1 will be described with reference to FIG. 1. FIG. 1 is a longitudinal sectional view showing the general structure of a full-color laser beam printer, which is an example of the image forming apparatus 1 according to this embodiment.

In the image forming apparatus 1 shown in FIG. 1, a cassette sheet feeding means 80 is provided at a lowermost portion, and a manual sheet feeding means 70 is provided at a right-hand portion. The cassette sheet feeding means 80 is provided with a paper (sheet) position detecting means (described specifically later) capable of detecting both end portion positions (both end positions) of a recording material P with respect to a direction (widthwise direction) perpendicular to a feeding direction of the recording material P. Above the cassette sheet feeding means 80, a registration roller 51 and a registration opposite roller 52, which register (positionally align) a leading end position of the recording material P, and which feed the recording material P, are provided.

Similarly, above the cassette sheet feeding means 80, a laser scanner unit 30 for forming an electrostatic latent image on a photosensitive member, as an image bearing member, is provided. Immediately on the laser scanner unit 30, a scanner frame 31 is provided, and the laser scanner unit 30 is fixed to the scanner frame 31.

Above the scanner frame 31, four process cartridges 10 (10Y, 10M, 10C, and 10Bk) are provided. On the process cartridges 10 (10Y, 10M, 10C, and 10Bk), an intermediary transfer unit 40 is provided so as to oppose the process cartridges 10 (10Y, 10M, 10C, and 10Bk). The intermediary transfer unit 40 includes an intermediary transfer belt 41. Inside the intermediary transfer belt 41, primary transfer rollers 42 (42Y, 42M, 42C, and 42Bk), a driving roller 43, a secondary transfer opposite roller 44 and a tension roller 45 are provided, and outside the intermediary transfer belt 41, a cleaning means 46 is provided.

On a right side of the intermediary transfer unit 40, a secondary transfer unit 90 is provided. The secondary transfer unit 90 includes a secondary transfer roller 91 as a part of an image forming portion so as to oppose the secondary transfer opposite roller 44. Here, the primary transfer rollers 42 (42Y, 42M, 42C, and 42Bk), the intermediary transfer belt 41 and the secondary transfer roller 91 constitute the image forming portion.

Above the intermediary transfer unit 40 and the secondary transfer unit 90, a fixing unit (fixing device) 20 is provided. Inside the fixing unit 20, a heating unit 21 for heating the recording material P and a pressing roller (nip-forming member) 22 for pressing (urging) the recording material P against the heating unit 21 are provided so as to form a nip in which the recording material P is nipped and fed.

Figure 2:
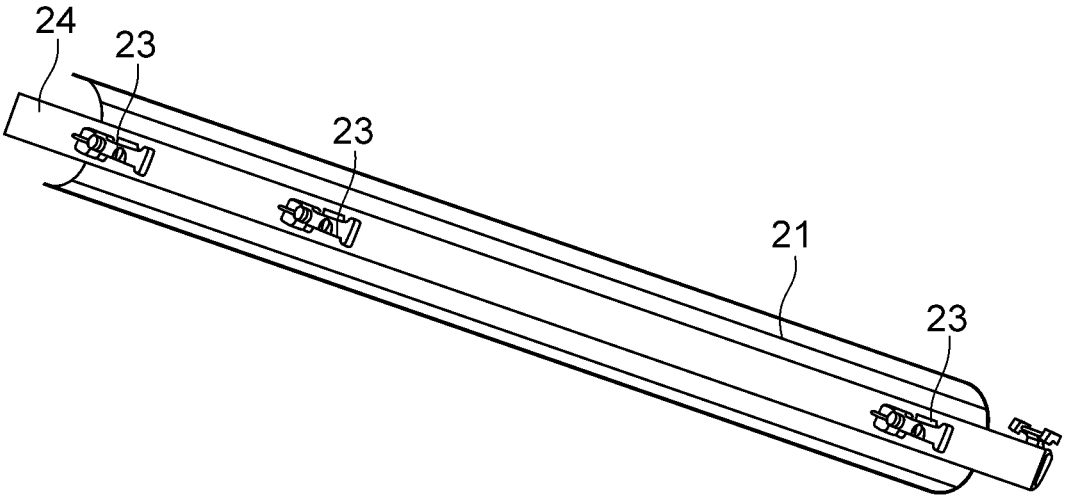
FIG. 2 is a perspective view of an inside of a heating unit.

As shown in FIG. 2, the heating unit 21 is provided with an elongated heater 24 extending in a longitudinal direction perpendicular to the feeding direction of the recording material P and is provided with at least two temperature detecting elements 23 for detecting the temperature of the heater 24. In the heating unit 21 in this embodiment, around the heater 24 supported by a heater holder 25, an unshown endless belt (film) is rotatably provided.

As shown in FIG. 1, the fixing unit 20 is provided with a cooling unit 100 including a cooling fan 101 for cooling both end portions of the heating unit 21, and is provided with a shielding unit 110 capable of changing a cooling portion for the heating unit 21. The shielding unit 110 is disposed in the neighborhood of the fixing unit 20.

Leftward above the fixing unit 20, a sheet discharging unit 60 is provided. The sheet discharging unit 60 includes a sheet discharging roller pair 61, a both-side feeding portion 62, a reversing roller pair 63, and a both-side flapper 64, which is a branching means. An image formation controller 2 collectively controls an image forming operation of the image forming apparatus 1.

Printing Operation

As shown in FIG. 1, when printing data including a print instruction and image information, and the like, are input from an unshown host computer, or the like, to the image formation controller 2, and the image formation controller 2 provides instructions to respective devices of the image forming apparatus 1 so as to start a printing operation. The recording material P is subjected to detection of a widthwise position thereof by the sheet position detecting means and is fed from the cassette sheet feeding means 80 by a feeding roller 81, a sheet feeding roller 82, and a sheet feeding opposite roller 83 and thus, is sent to a feeding path.

During image formation on a first sheet, the recording material P once stops in front of the secondary transfer roller 91 in a state of being nipped between the registration roller 51 and the registration opposite roller 52 for synchronization between feeding timing thereof and a forming operation of an image formed on the intermediary transfer belt 41. Then, the recording material P is fed after awaiting until image formation is carried out, but a second sheet and later sheets are continuously fed without being once stopped.

In synchronism with an operation of feeding the recording material P, developer images of respective colors, which are developed from electrostatic latent images by the process cartridges (10Y, 10M, 10C, and 10Bk), are successively transferred onto the intermediary transfer belt 41. The developer images (color image), superposed and transferred on the intermediary transfer belt 41, are moved together with the intermediary transfer belt 41 to a position of the secondary transfer opposite roller 44. Then, the once stopped recording material P is started to be fed by rotation of the registration roller 51 and the registration opposite roller 52, the recording material P enters a nip between the secondary transfer roller 91 and the intermediary transfer belt 41 in synchronism with the developer images, so that secondary transfer of the developer images onto the recording material P is carried out.

The color image transferred on the recording material P is heated by the heating unit 21 at a temperature set depending on a kind of the recording material P to be heated by the heater 24, and is melt-fixed on the recording material P by being pressed by the pressing roller 22. At this time, all the disposed temperature detecting elements 23 measure temperatures of the heater 24 at a predetermined sampling interval. The temperature detecting elements 23 send, to the image formation controller 2, temperature values from before the recording material P reaches a nip between the heating unit 21 and the pressing roller 22 until a trailing end of the recording material P comes out of the nip. The recording material P after fixing is discharged onto a discharge tray 65 by a sheet discharging roller pair 61, and then, a normal color image forming operation is ended.

On the intermediary transfer belt 41, a cleaning means 46 is provided, and the developer remaining on the intermediary transfer belt 41 is scraped off by a cleaning member, such as a cleaning blade, so that the image forming apparatus 1 prepares for subsequent image formation.

Shift Amount Detection of Recording Material with Respect to Widthwise Direction In the following, a shift (deviation) amount detection of the recording material P with respect to the widthwise direction by the sheet position detecting means in this embodiment will be described. In part (a) of FIG. 3, in order to detect positions of the recording material P (widthwise size: W) at both end portions with respect to a widthwise direction perpendicular to a recording material feeding direction, LED arrays Q (Q1 and Q2) and linear (one-dimensional) image pick-up (sensor) elements R (R1 and R2) are provided. Below the linear image pick-up elements R (R1 and R2) in part (a) of FIG. 3, lenses L, shown in part (b) of FIG. 3, are provided, respectively. A light quantity distribution of light received by the linear image pick-up elements R with respect to the widthwise direction of the recording material P is such that a light quantity of the light, when the light is reflected from the recording material P, is greater than a light quantity of the light reflected from a position deviated from the recording material P (i.e., a recording material mounting surface or a position deviated from the recording material P on a recording material feeding surface). As a result, due to a difference in light quantity, the positions of the recording material P at both end portions with respect to the widthwise direction are detectable.

Here, ideal positions of the recording material P at both end portions with respect to the widthwise direction, in a case in which the recording material P does not shift in the widthwise direction, are stored together with values of respective sizes of recording materials P in advance in the image forming apparatus 1 depending on the respective sizes of the recording materials P. As a result, in a case in which the recording material P shifts in the widthwise direction, a shift amount of the recording material P from an ideal position is detected.

A detecting means for detecting the shift amount of such a recording material P in the widthwise direction is provided inside the cassette sheet feeding means 80 (FIG. 1) so as to oppose the recording material mounting surface, or is provided so as to oppose the recording material feeding surface of a recording material feeding path toward the fixing unit 20 (FIG. 1). The case in which the recording material mounting surface or a region deviated from the recording material P on the recording material feeding surface is colored black is preferable, since a difference in light quantity is large and thus, the positions of the recording material P at both end portions with respect to the widthwise direction are easily detected.

Incidentally, the shift amount detection of the recording material P with respect to the widthwise direction may also be carried out using a transmission type, rather a reflection type in which the LED arrays Q (Q1 and Q2) and the linear image pick-up elements R (R1 and R2) are disposed on the same side, with respect to the recording material P. That is, the LED arrays Q (Q1 and Q2) and the linear image pick-up elements R (R1 and R2) may also be disposed on opposite sides with respect to the recording material P.

Constitution of Cooling Unit and Shielding Unit

As shown in FIG. 1, the cooling unit 100 includes the cooling fan 101. The cooling fan 101 draws outside air into the image forming apparatus 1 and blows the outside air to a duct 102. The outside air is thus sent to the shielding unit 110.

Part (a) of FIG. 4 is a perspective view of the shielding unit 110 as seen from the cooling fan 101 side, and part (b) of FIG. 4 is a perspective view of the shielding unit 110 as seen from the fixing unit 20 side. In the following description, "F-side" added as a prefix of each of respective members means that the member is provided on a front side of the image forming apparatus 1, and "R-side" added as a prefix of each of respective members means that the member is provided on a rear side of the image forming apparatus 1.

The shielding unit 110 includes a shielding frame 116. The shielding frame 116 holds (supports) an F-side driving motor 115 provided with an F-side pinion 115*a*, and an R-side driving motor 117 provided with an R-side pinion 117*a*. The shielding frame 116 is provided with an inlet port 116*a* for receiving the outside air sent from the duct 102, and exhaust ports 116*b* and 116*c* as openings for blowing the outside air to a heating roller 21.

A shielding member 111, capable of changing an opening width of the opening at one end portion with respect to the longitudinal direction of the fixing member, is attached to the shielding frame 116. Further, a shielding member 112, capable of changing an opening width of the opening at the other end portion with respect to the longitudinal direction of the fixing member, is attached to the shielding frame 116.

The F-side shielding member 111 includes a driven portion 111*a*, for the F-side shielding member 111, having a shape such that drive is transmittable from the F-side pinion 115*a* and, in addition, includes an F-side cap portion (shielding portion) 111*b*, provided separately from the driven portion 111*a*, for shielding the exhaust port 116*b*. The F-side cap portion 111*b* is provided with F-side rails 111*c* having a projection shape.

On the other hand, R-side shielding member 112 includes a driven portion 112*a*, for the R-side shielding member 111, having a shape such that drive is transmittable from the R-side pinion 117*a* and, in addition, includes an F-side cap portion (shielding portion) 112*b*, provided separately from the driven portion 112*a*, for shielding the exhaust port 116*c*. The R-side cap portion 112*b* is provided with R-side rails 112*c* having a projection shape.

Here, in FIG. 5 showing a side view of the shielding frame 116, as shown in part (a) of FIG. 5, which is the side view of the shielding frame 116 on the F-side, the shielding frame 116 is provided with guiding portions 116*d*. The F-side rails 111*c* enter the guiding portions 116*d* and are movable while being guided by the guiding portions 116*d*. As a result, the F-side shielding member 111 is supported by the shielding frame 116 and is slidable (movable) relative to the shielding frame 116.

Similarly, as shown in part (b) of FIG. 5, which is the side view of the shielding frame 116 on the R-side, the shielding frame 116 is provided with guiding portions 116*e*. The R-side rails 112*c* enter the guiding portions 116*e* and are movable while being guided by the guiding portions 116*e*. As a result, the R-side shielding member 112 is supported by the shielding frame 116 and is slidable (movable) relative to the shielding frame 116.

Shielding Unit Operation

An actual operation of the shielding unit 110 will be described with reference to FIG. 6. When a user sets the recording materials P in the cassette sheet feeding means 80, positions (for example, both end portion positions (both end positions)) with respect to the widthwise direction of the recording material P are detected by the sheet position detecting means, described above with reference to FIG. 3. A detection result is sent to the image formation controller 2, and whether or not detected values coincide with the predetermined values (reference positions) is discriminated by the image formation controller 2.

First, a case in which the positions of the end portions of the recording material P with respect to the widthwise direction control with the predetermined values (reference positions) will be described. In the case in which the recording material P is disposed and set at the predetermined position (in the case in which detection that the recording material P is not shifted in the widthwise direction is made in FIG. 3), the above-described printing operation is started. As shown in part (a) of FIG. 6, depending on a width of the recording material P, an operation instruction is provided from the image formation controller 2 to the F-side driving motor 115 and the R-side driving motor 117.

The F-side pinion 115*a* is rotated in an arrow A direction and drive is transmitted to the driven portion 111*a* for the F-side shielding member 111, so that the F-side shielding member 111 is moved in an arrow B direction. Simultaneously, the R-side pinion 117*a* is rotated in an arrow C direction and drive is transmitted to the driven portion 112*a* for the R-side shielding member 112, so that the R-side shielding member 112 is moved in an arrow D direction.

At this time, from the image formation controller 2 to the F-side driving motor 115 and the R-side driving motor 117, an instruction for moving the F-side shielding member 111 and the R-side shielding member 112 together by a movement amount x depending on the width of the recording material P is provided. As a result, both of opening amounts of the exhaust ports 116*b* and 116*c* are x (i.e., the opening widths are controlled so as to be equal to each other). As regards the movement amount x depending on the width of the recording material P, when the width of the recording material P is W and a length of the shielding unit 110 with respect to the longitudinal direction is U, in part (a) of FIG. 6, the following formula is satisfied:

$$U=W+2x.$$

By performing such an operation, the opening amounts of the exhaust ports 116*b* and 116*c* are caused to coincide with each other, so that the outside air sent from the cooling fan 101 can be blown to positions of the heating roller 21 outside the both end positions of the width of the recording material P, and thus, only necessary portions can be cooled.

Next, a case in which the positions (for example, both end portion positions (both end positions)) with respect to the widthwise direction of the recording material P do not coincide with the predetermined values (reference positions) and are shifted toward the rear side (R-side) of the image forming apparatus 1 by a shift amount y will be described.

First, depending on a widthwise position of the recording material P, an operation instruction is provided from the image formation controller 2 to the F-side driving motor 115 and the R-side driving motor 117.

As shown in part (b) of FIG. 6, the F-side pinion 115*a* is rotated in an arrow A direction and drive is transmitted to the driven portion 111*a* for the F-side shielding member 111, so that the F-side shielding member 111 is moved in an arrow B direction. Simultaneously, the R-side pinion 117*a* is rotated in an arrow C direction and drive is transmitted to the driven portion 112*a* for the R-side shielding member 112, so that the R-side shielding member 112 is moved in an arrow D direction.

At this time, from the image formation controller 2 to the F-side driving motor 115, an instruction for moving the F-side shielding member 111 by a total amount of the predetermined movement amount x and the shift amount y depending on the width position of the recording material P is provided, and from the image formation controller 2 to the R-side driving motor 117, an instruction for moving the R-side shielding member 112 by an amount obtained by subtracting the shift amount y from the predetermined movement amount x depending on the width position of the recording material P is provided. As a result, on the basis of an output of the detecting means for detecting the shift amount of the recording material P from a reference position with respect to the widthwise direction and a size of the recording material P with respect to the widthwise direction, the opening amount of the exhaust port 116*b* is x+y, and the opening amount of the exhaust port 116*c* is x−y (i.e., the opening widths are controlled so as to be different from each other).

By performing such an operation, the opening amounts of the exhaust ports 116*b* and 116*c* can be changed corresponding to shifted positions of the recording material P relative to the fixing device 20. As a result, the outside air sent from the cooling fan 101 can be blown to positions of the heating roller 21 outside the both (side) and positions of the width of the recording material P, so that only necessary portions (non-sheet-passing regions) can be cooled.

Here, in the case in which the widthwise end portion positions of the recording material P are shifted toward an opposite side (i.e., the front side of the fixing device 20), the opening amount of the exhaust port 116*b* is x−y, and the opening amount of the exhaust port 116*c* is x+y.

As described above, in this embodiment, the longitudinal (widthwise) end portion positions of the openings corresponding to first and second end portions of the fixing member with respect to the longitudinal direction can be caused to coincide with the associated end portion positions (side end positions) of the recording material P with respect to the widthwise direction. As a result, at each of the first and second end portions, the non-sheet-passing width and the opening width can be caused to coincide with each other.

As a result, in this embodiment, even in the case in which a widthwise center of the recording material P when passing through the fixing device 20 does not coincide with a reference position, the non-sheet-passing portion temperature rise can be properly prevented irrespective of the recording material size. Further, a deterioration of a fixing property on a side on which the recording material widthwise center is shifted is suppressed and temperature rise in a region through which the recording material P does not pass in the fixing member can be suppressed with reliability.

Further, a lowering in fixing property is prevented, so that productivity can be maintained.

Second Embodiment

In the First Embodiment, a constitution in which the widthwise positions of the recording material P are detected by the sheet position detecting means and the shielding unit 110 is operated depending on a detection result was employed. The present invention is not limited thereto, however, and a constitution in which the shielding unit 110 is operated on the basis of values sent from the plurality of temperature detecting elements 23 and values that are stored in the image formation controller 2 in advance and that depend on the kind (size information) of the recording material P may also be employed. In the following, a constitution in which the shielding unit 110 is operated on the basis of the values sent from the plurality of the temperature detecting elements 23 and values that are stored in the image formation controller 2 in advance and that depend on the kind of the recording material P will be described.

Shielding Unit Operation

Next, an actual operation of the shielding unit 110 will be described. When a printing operation is started by the user, the recording material P is started to be subjected to the above-described printing operation. The heater 24 is heated so that a temperature thereof is a predetermined temperature. The temperature of the heater 24 when the recording material P reaches the nip between the heating unit 21 and the pressing roller 22 is detected by the plurality of the temperature detecting elements 23, and detected values are sent to the image formation controller 2. The image formation controller 2 compares the values sent from the temperature detecting elements 23 with the preliminarily stored values depending on the kind (size information) of the recording material P, and discriminates whether or not a difference therebetween falls within a tolerable value.

First, a case in which the values sent from the temperature detecting elements 23 and the values that are stored in the image formation controller 2 in advance and that depend on the kind of the recording material P falls within a tolerable value, i.e., the case in which the widthwise positions of the recording material P coincide with predetermined positions determined in advance, will be described. FIG. 7 shows a temperature curve of the heater 24 with respect to the widthwise direction of the recording material P. In a graph of FIG. 7, an abscissa represents the widthwise direction, and an ordinate represents the temperature of the heater 24. In this embodiment, with respect to the widthwise direction of the recording material P, one temperature detecting element 23 was disposed at each of both ends of a sheet-passing region in which a maximum-size recording material P (maximum-size paper (sheet)) on which the toner image is fixable by the fixing unit 20 passes, and the temperature of the heater 24 was measured. As shown in FIG. 7, the values sent from the temperature detecting elements 23F and 23R and the preliminarily stored values depending on a recording material P (small-size paper) smaller in width than the maximum-size paper fall within a tolerable (predetermined) range, and, therefore, the image formation controller 2 discriminates that the positions of the recording material P do not shift relative to the heater 24 in the widthwise direction of the paper.

Depending on the width of the recording material P, an operation instruction is provided from the image formation controller 2 to the F-side driving motor 115 and the R-side driving motor 117.

The F-side pinion 115*a* is rotated in an arrow A direction and drive is transmitted to the driven portion 111*a* for the F-side shielding member 111, so that the F-side shielding member 111 is moved in an arrow B direction. Simultaneously, the R-side pinion 117*a* is rotated in an arrow C direction and drive is transmitted to the driven portion 112*a* for the R-side shielding member 112, so that the R-side shielding member 112 is moved in an arrow D direction.

At this time, from the image formation controller 2 to the F-side driving motor 115 and the R-side driving motor 117, an instruction for moving the F-side shielding member 111 and the R-side shielding member 112 together by a movement amount x depending on the width of the recording material P is provided.

By performing such an operation, the opening amounts of the exhaust ports 116*b* and 116*c* are caused to coincide with each other, so that the outside air sent from the cooling fan 101 can be blown to positions of the heating roller 21 outside the both end positions of the width of the recording material P, and thus, only necessary portions can be cooled.

Next, a case in which the values sent from the temperature detecting elements 23 and the values that are stored in the image formation controller 2 in advance and that depend on the kind (size information) of the recording material P exceeds the predetermined range will be described. FIG. 9 shows a temperature curve of the heater 24 with respect to the widthwise direction of the recording material P in the case of exceeding the predetermined range. In a graph of FIG. 9, an abscissa represents the widthwise direction, and an ordinate represents the temperature of the heater 24. FIG. 9 shows a state in which the values sent from the temperature detecting elements 23F and 23R do not coincide with the preliminarily stored range depending on the kind of the recording material P and in which the value sent from the temperature detecting element 23F is high and the value sent from the temperature detecting element 23R is low.

Thus, in the case in which the value sent from the temperature detecting element 23R is less than the predetermined range depending on the kind of the recording material P, the image formation controller 2 discriminates that, with respect to the widthwise direction of the recording material P, an associated end of the recording material P is closer to the temperature detecting element 23R than is the end of the recording material P when the recording material P is in an ideal position. This is because it would be considered that a detection temperature of the temperature detecting element 23R lowers since the associated end of the recording material P approaches the temperature detecting element 23 compared with that when the recording material P is in the ideal position and heat of the heater 24 is conducted to the recording material P in a greater amount.

Similarly, in a case in which the value sent from the temperature detecting element 23F is greater than the predetermined range depending on the kind of the recording material P, the image formation controller 2 discriminates that, with respect to the widthwise direction of the recording material P, an associated end of the recording material P is more remote from the temperature detecting element 23F than is the end of the recording material P when the recording material P is in an ideal position. This is because it would be considered that a detection temperature of the temperature detecting element 23F increases since the associated end of the recording material P is spaced apart from the temperature detecting element 23 compared with that when the recording material P is in the ideal position and heat of the heater 24 is not dissipated without being conducted to the recording material P.

Further, with respect to the widthwise direction of the recording material P, the image formation controller 2 not only discriminates that a center position of the recording material P is shifted (deviated) from a position (ideal position) in which the recording material center position overlaps (coincides) with a center position of the fixing unit 20 (the heater 24), but also predicts the shift amount (deviation amount) from the difference between the value depending on the kind of the recording material P and each of the values sent from the temperature detecting elements 23F and 23R.

Further, depending on a widthwise position of the recording material P, an operation instruction is provided from the image formation controller 2 to the F-side driving motor 115 and the R-side driving motor 117.

As shown in part (b) of FIG. 9, the F-side pinion 115*a* is rotated in an arrow A direction and drive is transmitted to the driven portion 111*a* for the F-side shielding member 111, so that the F-side shielding member 111 is moved in an arrow B direction. Simultaneously, the R-side pinion 117*a* is rotated in an arrow C direction and drive is transmitted to the driven portion 112*a* for the R-side shielding member 112, so that the R-side shielding member 112 is moved in an arrow D direction.

At this time, by the image formation controller 2, the F-side driving motor 115 is driven so that the F-side shielding member 111 is moved in a total amount of the predetermined movement amount x and the shift amount y depending on the width position of the recording material P, and by the image formation controller 2, the R-side driving motor 117 is driven so that the R-side shielding member 112 is moved in an amount obtained by subtracting the shift amount y from the predetermined movement amount x depending on the width position of the recording material P. As a result, on the basis of an output of the detecting means for detecting the shift amount of the recording material P from a reference position with respect to the widthwise direction and size information of the recording material P with respect to the widthwise direction, the opening amount of the exhaust port 116*b* is x+y, and the opening amount of the exhaust port 116*c* is x−y (i.e., the opening widths are controlled so as to be different from each other).

By performing such an operation, the opening amounts of the exhaust ports 116*b* and 116*c* can be changed corresponding to shifted positions of the recording material P relative to the fixing device 20. As a result, the outside air sent from the cooling fan 101 can be blown to positions of the heating roller 21 outside the both (side) and positions of the width of the recording material P, so that only necessary portions (non-sheet-passing regions) can be cooled.

Here, in the case in which the value sent from the temperature detecting element 23F is low and the value sent from the temperature detecting element 23R is high, the image formation controller 2 can discriminate that the recording material P shifts toward the temperature detecting element 23F side, so that the opening amount of the exhaust port 116*b* is x−y, and the opening amount of the exhaust port 116*c* is x+y.

Thus, in this embodiment, the longitudinal (widthwise) end portion positions of the openings corresponding to first and second end portions of the fixing member with respect to the longitudinal direction can be caused to coincide with the associated end positions of the recording material P with respect to the widthwise direction by detecting the temperature of the heater 24 by the plurality of temperature detecting elements 23, and then, by predicting the shift amount from a detection result. As a result, at each of the first and second end portions, the non-sheet-passing width and the opening width can be caused to coincide with each other.

As a result, in this embodiment, even in the case in which a widthwise center of the recording material P, when passing through the fixing device 20, does not coincide with a reference position, the non-sheet-passing portion temperature rise can be properly prevented irrespective of the recording material size. Further, a deterioration of a fixing property on a side on which the recording material widthwise center is shifted is suppressed, and temperature rise in a region through which the recording material P does not pass in the fixing member can be suppressed with reliability. Further, a lowering in fixing property is prevented, so that productivity can be maintained.

Third Embodiment

In the First Embodiment, the driving motors and the pinions, which correspond to those for F-side and the R-side, are separately provided, but in this embodiment, a driving motor and a pinion are common to the F-side and the R-side. Incidentally, constituent elements and operations that are similar to those in the First Embodiment are represented by the same reference numerals or symbols and will be omitted from description.

Shielding Unit Structure

Part (a) of FIG. 10 is a perspective view of a shielding unit 210 in this embodiment as seen from an upper portion of the cooling fan 101 (FIG. 1). Part (b) of FIG. 10 is a perspective view of the shielding unit 210 in this embodiment as seen from an upper portion of the fixing unit 20 (FIG. 1). The shielding unit 210 includes a shielding frame 116 that holds a driving motor 220 provided with a pinion 220*a*.

As shown in FIGS. 10 and 11, an F-side shielding member 211 in this embodiment is constituted by an F-side driving member 213 to which drive is transmitted from the pinion 220*a*, and by an F-side cap member 214 as a shielding member for shielding the exhaust port 116*b*. The F-side cap member 214 is provided with F-side rails 214*c* having a projection shape. The F-side rails 214*c* enter the guiding portions 116*d* (part (a) of FIG. 6) of the shielding frame 116, so that the F-side shielding member 213 is movable.

Part (b) of FIG. 11 is a partially enlarged view of the F-side shielding member 211 (part (a) of FIG. 11). As shown in part (a) of FIG. 11, the F-side driving member 213 is provided with an elongated hole (long hole) 213*a* extending in a movement direction of the F-side shielding member 211 with substantially the same short diameter. The F-side cap member 214 is provided with a shaft 214*a*, and the shaft 214*a* enters the elongated hole 213*a* of the F-side driving member 213, so that the F-side driving member 213 and the F-side cap member 214 are engaged and connected with each other with respect to a height direction of the image forming apparatus 1. A long diameter of the elongated hole 213*a* of the F-side driving member 213 is set at a length that is a sum of a shaft diameter of the shaft 214*a* and left and right gaps t adjacent to the shaft 214*a*.

That is, in this embodiment, the driving motor 220, as a common driving source, for changing widths of the openings corresponding to the first and second end portions, respectively, of the fixing member with respect to the longitudinal direction, is provided. Further, a moving mechanism portion including a movement dead region, such that only a first predetermined amount is not changed when the opening width for one of the first and second end portions is intended to be changed with respect to a first direction of the longitudinal direction, and such that only a second predetermined amount is not changed when the opening width for one of the first and second end portions is intended to be changed with respect to a second direction opposite to the first direction of the longitudinal direction, is provided. Here, the first predetermined amount and the second predetermined amount can be made the same value t.

Further, the F-side cap member 214 is connected with the F-side driving member 213 as a drive transmitting portion to which drive (driving force) is transmitted from the driving source, and the F-side driving member 213 is provided with the elongated hole 213*a* extending in the longitudinal direction. Further, the F-side cap member 214 includes the shaft 214*a* forming play on both sides thereof relative to the elongated hole 213*a*.

Shielding Unit Operation

An actual operation of the shielding unit 210 in this embodiment will be described.

(1) A case in which widthwise positions (for example, both end portion positions (both side end positions)) of recording material P coincide with predetermined values (reference positions):

When detection that the recording material P is disposed and set at a predetermined position is made by the sheet position detecting means of FIG. 3, the above-described printing operation is started. As shown in part (a) of FIG. 12, depending on the width of the recording material P, an operation instruction is provided from the image formation controller 2 (FIG. 1) to the driving motor 220 (part (a) of FIG. 8). The pinion 220*a* rotates in the arrow A direction and the drive is transmitted to the driven portion 112*a* for the R-side shielding member 112, so that the R-side shielding member 112 is moved in the arrow B direction. Similarly, the pinion 220*a* transmits the drive to the F-side driving member 213, so that the F-side driving member 213 is moved in the arrow C direction.

At this time, from the image formation controller 2 to the driving motor 220, an instruction for moving the R-side shielding member 112 in a distance corresponding to a sum of a movement amount x portion the width of the recording material P and a gap t is provided. For that reason, as shown in part (a) of FIG. 12, an opening amount of the R-side exhaust port 116*c* is x+t.

On the other hand, the F-side driving member 213 moves in the arrow C direction, but as described above with reference to part (b) of FIG. 11, the gaps t are provided between the shaft 214*a* of the F-side shielding member 214 and longitudinal ends of the elongated hole 213*a* of the F-side driving member 213. For this reason, the F-side cap member 214 is not moved until the associated end of the elongated hole 213*a* of the F-side driving member 213 abuts against the shaft 214*a* of the F-side cap member 214 (i.e., corresponding to the gap t). Then, after contact of the associated end of the elongated hole 213*a* of the F-side driving member 213 with the shaft 214*a* of the F-side cap member 214, the F-side cap member 214 is moved. For that reason, as shown in part (a) of FIG. 12, an opening amount of the F-side exhaust port 116*b* is x.

Here, an unshown spring (urging means) provided on the shielding frame 116 always urges the F-side cap member 214 including the shaft 214*a* and thus prevents the F-side cap member 214 from moving. That is, a brake (braking force) is exerted on the F-side cap member 214, and due to friction generated at a contact portion between the longitudinal end of the elongated hole 213*a* and the shaft 214*a*, the F-side cap member 214 is prevented from moving together with the F-side driving member 213.

Next, the image formation controller 2 provides an instruction for moving the pinion 220*a* from the above-described state of part (a) of FIG. 12 in the arrow D direction (opposite to the arrow A direction) shown in part (b) of FIG. 12. Then, the pinion 220*a* rotates in the arrow D direction and moves the R-side shielding member 112 in the arrow C direction. Similarly, the pinion 220*a* moves the F-side driving member 213 in the arrow B direction. At this time, from the image formation controller 2 to the driving motor 220, an instruction for moving the R-side shielding member 112 by the gap t is provided. For that reason, the opening amount of the R-side exhaust port 116*c* is x (part (b) of FIG. 12).

On the other hand, the F-side driving member 213 including the elongated hole 213*a* (part (b) of FIG. 11) moves in a distance corresponding to the gap tin the arrow B direction shown in part (b) of FIG. 12. The associated end of the elongated hole 213*a* is merely spaced from the shaft 214*a*, however, and the other end of the elongated hole 213*a* does not contact the shaft 214*a*, so that the F-side cap member 214 is not moved. Therefore, the opening amount of the F-side exhaust port 116*b* is kept unchanged at x.

By performing such an operation, the opening amounts of the exhaust ports 116*b* and 116*c* are caused to coincide with each other (part (b) of FIG. 12), so that the outside air sent from the cooling fan 101 can be blown to outsides of the both end positions of the width of the recording material P of the heating roller 21 and thus, only necessary portions can be cooled.

(2) A case in which widthwise positions (for example, both end portion positions (both side end positions)) of recording material P do not coincide with predetermined values (reference positions):

Next, the case in which detection that the recording material P moved toward the rear side (R-side) of the fixing device 20 with respect to the widthwise direction of the recording material P is made by the sheet position detecting means of FIG. 3 and the case in which detection that the recording material P moved toward the front side (F-side) of the fixing device 20 with respect to the widthwise direction of the recording material P is made by the sheet position detecting means will be described in a named order.

(2-a) A case in which the recording material is moved toward a rear side (R-side) of the fixing device:

First, the case in which widthwise positions (for example, both end portion positions (both side end positions)) of the recording material P do not coincide with the predetermined positions (reference positions) and in which the recording material P is moved toward the rear side (R-side) of the fixing device 20 with respect to the widthwise direction of the recording material P in a distance corresponding to the shift amount deviation amount y will be described. As shown in part (a) of FIG. 13, depending on the width of the recording material P, an operation instruction is provided from the image formation controller 2 (FIG. 1) to the driving motor 220 (part (a) of FIG. 8). The pinion 220*a* rotates in the arrow A direction and the drive is transmitted to the driven portion 112*a* for the R-side shielding member 112, so that the R-side shielding member 112 is moved in the arrow B direction. Similarly, the pinion 220*a* transmits the drive to the F-side driving member 213, so that the F-side driving member 213 is moved in the arrow C direction.

At this time, from the image formation controller 2 to the driving motor 220, an instruction for moving the R-side shielding member 112 in a distance corresponding to a sum of a movement amount x portion the width of the recording material P, the gap t and the shift amount y is provided. For that reason, as shown in part (a) of FIG. 13, an opening amount of the R-side exhaust port 116*c* is (x+t)+y.

On the other hand, the F-side driving member 213 moves in the arrow C direction, but as described above with reference to part (b) of FIG. 11, the gaps t are provided between the shaft 214*a* of the F-side shielding member 214 and longitudinal ends of the elongated hole 213*a* of the F-side driving member 213. For this reason, the F-side cap member 214 is not moved until the associated end of the elongated hole 213*a* of the F-side driving member 213 abuts against the shaft 214*a* of the F-side cap member 214 (i.e., corresponding to the gap t). Then, after contact of the associated end of the elongated hole 213*a* of the F-side driving member 213 with the shaft 214*a* of the F-side cap member 214, the F-side cap member 214 is moved. For that reason, as shown in part (a) of FIG. 13, an opening amount of the F-side exhaust port 116*b* is x+y.

Next, the image formation controller 2 provides an instruction for moving the pinion 220*a* from the above-described state of part (a) of FIG. 13 in the arrow D direction (opposite to the arrow A direction) shown in part (b) of FIG. 13. Then, as shown in part (b) of FIG. 13, the pinion 220*a* rotates in the arrow D direction and moves the R-side shielding member 112 in the arrow C direction. Similarly, the pinion 220*a* moves the F-side driving member 213 in the arrow B direction. At this time, from the image formation controller 2 to the driving motor 220, an instruction for moving the R-side shielding member 112 by a sum of the gap t and twice the shift amount y is provided. For that reason, the opening amount of the R-side exhaust port 116*c* is (x+t)+y−(t+2y)=x−y (part (b) of FIG. 13).

On the other hand, the F-side driving member 213 moves in a distance corresponding to the sum of the gap t and twice the shift amount y in the arrow B direction. The associated end of the elongated hole 213*a* is merely spaced from the shaft 214*a*, however, and as regards a sum of the left and right gaps t (twice the gap t) of the shaft 214*a*, the other end of the elongated hole 213*a* does not contact the shaft 214*a*, and, therefore, the F-side cap member 214 is not moved. Therefore, the opening amount of the F-side exhaust port 116*b* is kept unchanged at x+y when twice the gap t is made greater than the sum of the gap t and twice the shift amount y, i.e., when the gap t is made greater than twice the shift amount y.

By the above-described operation, even when the side end positions of the recording material P shift in the widthwise direction from the reference positions at which the recording material P should be originally located, the positions of the exhaust ports 116*b* and 116*c* can be changed so that opening regions of the exhaust ports 116*b* and 116*c* can be controlled with end portion regions of the fixing member deviated from the reference positions of the recording material P. That is, the outside air sent from the cooling fan 101 can be blown to the both end regions deviated from the (original) widthwise regions of the recording material P on the heating roller 21, so that only necessary portions can be cooled.

(2-b) A case in which the recording material is moved toward the front side (F-side) of the fixing device:

Next, for a case in which the widthwise positions (for example, both end portion positions (both side end positions)) of the recording material P do not coincide with the predetermined positions (reference positions) and in which the recording material P is moved toward the front side (F-side) of the fixing device 20 with respect to the widthwise direction of the recording material P in a distance corresponding to a shift amount deviation amount z will be described using FIG. 14. Although FIG. 14 and FIG. 13 are consistent with each other based on the relationship of z=−y, a description will be made specifically below.

As shown in part (a) of FIG. 14, depending on the width of the recording material P, an operation instruction is provided from the image formation controller 2 to the driving motor 220. The pinion 220*a* rotates in the arrow A direction and the drive is transmitted to the driven portion 112*a* for the R-side shielding member 112, so that the R-side shielding member 112 is moved in the arrow B direction. Similarly, the pinion 220*a* transmits the drive to the F-side driving member 213, so that the F-side driving member 213 is moved in the arrow C direction.

At this time, from the image formation controller 2 to the driving motor 220, an instruction for moving the R-side shielding member 112 in a distance corresponding to an amount obtained by subtracting the shift amount z from the sum of the movement amount x portion the width of the recording material P and the gap t is provided. For that reason, as shown in part (a) of FIG. 14, an opening amount of the R-side exhaust port 116*c* is (x+t)−z.

On the other hand, the F-side driving member 213 moves in the arrow C direction, but as described above with reference to part (b) of FIG. 11, the gaps t are provided between the shaft 214*a* of the F-side shielding member 214 and longitudinal ends of the elongated hole 213*a* of the F-side driving member 213. For this reason, the F-side cap member 214 is not moved until the associated end of the elongated hole 213*a* of the F-side driving member 213 abuts against the shaft 214*a* of the F-side cap member 214 (i.e., corresponding to the gap t). Then, after contact of the associated end of the elongated hole 213*a* of the F-side driving member 213 with the shaft 214*a* of the F-side cap member 214, the F-side cap member 214 is moved. For that reason, as shown in part (a) of FIG. 14, an opening amount of the F-side exhaust port 116*b* is x−z.

Next, the image formation controller 2 provides an instruction for moving the pinion 220*a* from the above-described state of part (a) of FIG. 14 in the arrow D direction (opposite to the arrow A direction) shown in part (b) of FIG. 14. Then, as shown in part (b) of FIG. 14, the pinion 220*a* rotates in the arrow D direction and moves the R-side shielding member 112 in the arrow C direction. Similarly, the pinion 220*a* moves the F-side driving member 213 in the arrow B direction. At this time, from the image formation controller 2 to the driving motor 220, an instruction for moving the R-side shielding member 112 by an amount obtained by subtracting twice the shift amount z from the gap t is provided. For that reason, the opening amount of the R-side exhaust port 116*c* is (x+t)−z−(t−2z)=x+z (part (b) of FIG. 14).

On the other hand, the F-side driving member 213 moves in a distance corresponding to the amount obtained by subtracting twice the shift amount z from the gap tin the arrow B direction. The associated end of the elongated hole 213*a* is merely spaced from the shaft 214*a*, however, and the sum of the left and right gaps t (twice the gap t) is greater than the amount obtained by subtracting twice the shift amount z from the gap t, so that the shaft 214*a*. For this reason, the opening amount of the F-side exhaust port 116*b* is kept unchanged at x−z.

By the above-described operation, even when the side end positions of the recording material P shift in the widthwise direction from the reference positions at which the recording material P should be originally located, the positions of the exhaust ports 116*b* and 116*c* can be changed so that opening regions of the exhaust ports 116*b* and 116*c* control with end portion regions of the fixing member deviated from the reference positions of the recording material P. That is, the outside air sent from the cooling fan 101 can be blown to the both end regions deviated from the (original) widthwise regions of the recording material P on the heating roller 21, so that only necessary portions can be cooled.

As described above, in the above-described embodiments, even in the case in which widthwise centers of the recording materials do not coincide with each other when the recording materials P pass through the fixing device 20, the non-sheet-passing portion temperature rise can be properly prevented irrespective of the size of the recording material P. Further, deterioration of the fixing property, on a side relative to the widthwise center of the recording material that is deviated, is suppressed, so that temperature rise in a region through which the recording material P does not pass in the fixing member can be suppressed with reliability. Further, a lowering in fixing property is prevented, so that productivity can be maintained.

Fourth Embodiment

In the Fourth Embodiment, similarly as in the Third Embodiment, while employing the constitution including the shielding unit 110 in which the driving motor and the pinion are common to the F-side and the R-side, similarly as in the Second Embodiment, the constitution in which the shielding unit 110 is operated on the basis of the values sent from the plurality of temperature detecting elements 23 and the preliminarily stored values depending on the kind of the recording material P is employed. This constitution will be described below. Incidentally, constituent elements and operations that are similar to those in the First Embodiment are represented by the same reference numerals or symbols and will be omitted from description.

Shielding Unit Operation

An actual operation of the shielding unit 210 in this embodiment will be described.

(1) A case in which values sent from temperature detecting elements 23 and preliminarily stored values depending on the kind (size information) of recording material P fall within tolerable range:

As shown in part (a) of FIG. 12, depending on the width of the recording material P, an operation instruction is provided from the image formation controller 2 (FIG. 1) to the driving motor 220. The pinion 220*a* rotates in the arrow A direction and the drive is transmitted to the driven portion 112*a* for the R-side shielding member 112, so that the R-side shielding member 112 is moved in the arrow B direction. Similarly, the pinion 220*a* transmits the drive to an F-side driven member 213, so that the F-side driven member 213 is moved in the arrow C direction.

At this time, the image formation controller 2 causes the driving motor 220 to be driven so that the driven portion 112*a* for the R-side shielding member 112 and the F-side driven member 213 are moved in a distance corresponding to a sum of a movement amount x portion the width of the recording material P and a gap t is provided. For that reason, the R-side shielding member 112 moves in the distance corresponding to the sum of the movement amount x and the gap t, so that an opening amount of the R-side exhaust port 116*c* is x+t.

On the other hand, the F-side driven member 213 moves in the arrow C direction, but as described above with reference to part (b) of FIG. 11, the gaps t are provided between the shaft (projection portion) 214*a* of the F-side shielding member 214 and longitudinal ends of the elongated hole 213*a* of the F-side driven member 213. For this reason, as shown in part (c) of FIG. 11, the F-side cap member 214 is not moved until the associated end of the elongated hole 213*a* of the F-side driven member 213 abuts against the projection portion 214*a* of the F-side cap member 214 (i.e., corresponding to the gap t). Then, after contact of the associated end of the elongated hole 213*a* of the F-side driven member 213 with the projection portion 214*a* of the F-side cap member 214, the F-side cap member 214 is moved. For that reason, the F-side cap member 214 does not move in a distance corresponding to the gap t, and, therefore, as shown in part (a) of FIG. 12, an opening amount of the F-side exhaust port 116*b* is x.

Incidentally, in this embodiment, a constitution in which an unshown spring (urging means) is provided on the shielding frame 116 is employed, and the spring always urges the F-side cap member 214 against the shielding frame 116 and thus prevents the F-side cap member 214 from moving relative to the shielding frame 116. That is, a braking force is exerted by the spring on the F-side cap member 214 so as not to move limitlessly while ensuring a state in which the F-side cap member 214 is supported by the shielding frame 116, and due to a frictional force generating during sliding between an inner surface of the elongated hole 213*a* and the projection portion 214*a*, the F-side cap member 214 is prevented from moving.

Next, the image formation controller 2 provides an instruction for moving the pinion 220*a* from the above-described state of part (a) of FIG. 12 in the arrow D direction (opposite to the arrow A direction) shown in part (b) of FIG. 12. Then, as shown in part (b) of FIG. 12, the pinion 220*a* rotates in the arrow D direction and moves the R-side shielding member 112 in the arrow C direction. Similarly, the pinion 220*a* moves the F-side driven member 213 in the arrow B direction. At this time, the image formation controller 2 causes the driving motor 220 to be driven so that the driven portion 112*a* for the R-side shielding member 112 is moved by the gap t. For that reason, the R-side shielding member 112 moves in a distance corresponding to the gap t, and, therefore, the opening amount of the R-side exhaust port 116*c* is x (part (b) of FIG. 10).

On the other hand, the F-side driven member 213 moves in a distance corresponding to the gap tin the arrow B direction shown in part (b) of FIG. 10. The associated end of the elongated hole 213*a* is spaced from the shaft 214*a*, however, and is in a position in the elongated hole 213*a* with a gap t with respect to each of the arrow B direction and the arrow C direction. Thus, the other end of the elongated hole 213*a* does not contact the projection portion 214*a*, so that the F-side cap member 214 is not moved. Therefore, the opening amount of the F-side exhaust port 116*b* is kept unchanged at x.

By performing such an operation, the opening amounts of the exhaust ports 116*b* and 116*c* are caused to coincide with each other (part (b) of FIG. 12), so that the outside air sent from the cooling fan 101 can be blown to outsides of the both end positions of the width of the recording material P of the heating unit 21 and thus, only necessary portions can be cooled.

(2) A case in which values sent from temperature detecting elements 23 and preliminarily stored values depending on a kind (size information) of recording material P do not fall within tolerable range:

Next, the case in which detection that the recording material P moved toward the rear side (R-side) of the fixing device 20 with respect to the widthwise direction of the recording material P is made on the basis of differences between the values sent from the temperature detecting elements 23F and 23R and the values depending on the kind of the recording material P and the case in which detection that the recording material P moved toward the front side (F-side) of the fixing device 20 with respect to the widthwise direction of the recording material P is made on the basis of the differences between the values sent from the temperature detecting elements 23F and 23R and the values depending on the kind of the recording material P will be described in a named order.

(2-a) A case in which the recording material is moved toward the rear side (R-side) of the fixing device:

First, as shown in FIG. 13, the case in which detection that the widthwise position of the recording material P moved toward the rear side of the fixing device 20 in a distance corresponding to an amount y is made on the basis of the differences between the values sent from the temperature detecting elements 23F and 23R and the values depending on the kind of the recording material P will be described. Depending on the width of the recording material P, an operation instruction is provided from the image formation controller 2 (FIG. 1) to the driving motor 220. The pinion 220*a* rotates in the arrow A direction and the drive is transmitted to the driven portion 112*a* for the R-side shielding member 112, so that the R-side shielding member 112 is moved in the arrow B direction. Similarly, the pinion 220*a* transmits the drive to the F-side driven member 213, so that the F-side driven member 213 is moved in the arrow C direction.

At this time, the image formation controller 2 causes the driving motor 220 to be driven so that the R-side shielding member 112 is moved in a distance corresponding to a sum of a movement amount x portion the width of the recording material P, the gap t and the shift amount y is provided. For that reason, as shown in part (a) of FIG. 13, the R-side shielding member 112 moves in a distance of (x+t)+y, so that an opening amount of the R-side exhaust port 116*c* is (x+t)+y.

On the other hand, the F-side driven member 213 moves in the arrow C direction, but as described above with reference to part (b) of FIG. 11, the gaps t are provided between the projection portion 214*a* of the F-side shielding member 214 and longitudinal ends of the elongated hole 213*a* of the F-side driven member 213. For this reason, as shown in part (c) of FIG. 11, the F-side cap member 214 is not moved until the associated end of the elongated hole 213*a* of the F-side driven member 213 abuts against the projection portion 214*a* of the F-side cap member 214 (i.e., corresponding to the gap t). Then, after contact of the associated end of the elongated hole 213*a* of the F-side driven member 213 with the projection portion 214*a* of the F-side cap member 214, the F-side cap member 214 is moved. For that reason, the movement amount of the F-side cap member 214 is x+y, and as shown in part (a) of FIG. 13, an opening amount of the F-side exhaust port 116*b* is x+y.

Next, the image formation controller 2 provides an instruction for moving the pinion 220*a* from the above-described state of part (a) of FIG. 13 in the arrow D direction (opposite to the arrow A direction) shown in part (b) of FIG. 13. Then, the pinion 220*a* rotates in the arrow D direction and moves the R-side shielding member 112 in the arrow C direction. Similarly, the pinion 220*a* moves the F-side driven member 213 in the arrow B direction. At this time, the image formation controller 2 causes the driving motor 220 to be driven so that the R-side shielding member 112 is moved in a distance corresponding to a sum of the gap t and twice the shift amount y. For that reason, the opening amount of the R-side exhaust port 116*c* is (x+t)+y−(t+2y)=x−y (part (b) of FIG. 13).

On the other hand, the F-side driven member 213 moves in a distance corresponding to the sum of the gap t and twice the shift amount y in the arrow B direction. The associated end of the elongated hole 213*a* is merely spaced from the projection portion 214*a*, however, and as regards a sum of the left and right gaps t (twice the gap t) of the projection portion 214*a*, the other end of the elongated hole 213*a* does not contact the projection portion 214*a*, and, therefore, the F-side cap member 214 is not moved. Therefore, the opening amount of the F-side exhaust port 116*b* is kept unchanged at x+y when twice the gap t is made greater than the sum of the gap t and twice the shift amount y, i.e., when the gap t is made greater than twice the shift amount y.

By the above-described operation, even when the side end positions of the recording material P shift in the widthwise direction from the reference positions at which the recording material P should be originally located, the positions of the exhaust ports 116*b* and 116*c* can be changed so that opening regions of the exhaust ports 116*b* and 116*c* control with end portion regions of the fixing member deviated from the reference positions of the recording material P. That is, the outside air sent from the cooling fan 101 can be blown to the both end regions deviated from the (original) widthwise regions of the recording material P on the heating unit 21, so that only necessary portions can be cooled.

(2-b) A case in which the recording material is moved toward the front side (F-side) of the fixing device:

Next, a case in which the values sent from the temperature detecting elements 23 and the preliminarily stored values depending on the kind of the recording material P exceed the tolerable range and in which the recording material P moved toward the front side (F-side) of the fixing device 20 with respect to the widthwise direction of the recording material P in a distance corresponding to a shift amount deviation amount z will be described using FIG. 14. Although FIG. 14 and FIG. 13 are consistent with each other based on the relationship of z=−y, a description will be made specifically below. FIG. 15 shows a temperature curve of the heater 24 with respect to the widthwise direction of the recording material P in the case of exceeding the tolerable range (predetermined range). In a graph of FIG. 15, the abscissa represents the widthwise direction of the recording material P, and the ordinate represents the temperature of the heater 24. At this time, in the case in which the value sent from the temperature detecting element 23F is less than the predetermined range depending on the kind of the recording material P, so that the image formation controller 2 discriminates that with respect to the widthwise direction of the recording material P, an associated end of the recording material P is closer to the temperature detecting element 23F than is the end of the recording material P when the recording material P is in an ideal position. Similarly, the value sent from the temperature detecting element 23R is greater than the predetermined range depending on the kind of the recording material P, so that the image formation controller 2 discriminates that, with respect to the widthwise direction of the recording material P, an associated end of the recording material P is more remote from the temperature detecting element 23R than is the end of the recording material P when the recording material P is in an ideal position. Thus, the image formation controller 2 discriminates that the recording material P shifts toward the temperature detecting element 23F side compared with that when the recording material P is in the ideal position. Further, the image formation controller 2 predicts the shift amount z on the basis of the differences between the values sent from the temperature detecting elements 23F and 23R and the values depending on the kind of the recording material P.

As shown in part (a) of FIG. 14, depending on the width of the recording material P, an operation instruction is provided from the image formation controller 2 to the driving motor 220. The pinion 220*a* rotates in the arrow A direction and the drive is transmitted to the driven portion 112*a* for the R-side shielding member 112, so that the R-side shielding member 112 is moved in the arrow B direction. Similarly, the pinion 220*a* transmits the drive to the F-side driven member 213, so that the F-side driven member 213 is moved in the arrow C direction.

At this time, the image formation controller 2 causes the driving motor 220 to be driven so that the R-side shielding member 112 is moved in a distance corresponding to an amount obtained by subtracting the shift amount z from the sum of the movement amount x portion the width of the recording material P and the gap t is provided. For that reason, as shown in part (a) of FIG. 14, an opening amount of the R-side exhaust port 116*c* is (x+t)−z.

On the other hand, the F-side driven member 213 moves in the arrow C direction, but as described above with reference to part (b) of FIG. 11, the gaps t are provided between the shaft 214*a* of the F-side shielding member 214 and longitudinal ends of the elongated hole 213*a* of the F-side driven member 213. For this reason, the F-side cap member 214 is not moved until the associated end of the elongated hole 213*a* of the F-side driving member 213 abuts against the projection portion 214*a* of the F-side cap member 214 (i.e., corresponding to the gap t). Then, as shown in part (c) of FIG. 11 after contact of the associated end of the elongated hole 213*a* of the F-side driven member 213 with the projection portion 214*a* of the F-side cap member 214, the F-side cap member 214 is moved. For that reason, as shown in part (a) of FIG. 14, an opening amount of the F-side exhaust port 116*b* is x−z.

Next, the image formation controller 2 provides an instruction for moving the pinion 220*a* from the above-described state of part (a) of FIG. 14 in the arrow D direction (opposite to the arrow A direction) shown in part (b) of FIG. 14. Then, as shown in part (b) of FIG. 14, the pinion 220*a* rotates in the arrow D direction and moves the R-side shielding member 112 in the arrow C direction. Similarly, the pinion 220*a* moves the F-side driven member 213 in the arrow B direction. At this time, the image formation controller 2 causes the driving motor 220 is moved to be driven so that the R-side shielding member 112 is moved by an amount obtained by subtracting twice the shift amount z from the gap t. For that reason, the opening amount of the R-side exhaust port 116*c* is (x+t)−z−(t−2z)=x+z (part (b) of FIG. 14).

On the other hand, the F-side driven member 213 moves in a distance corresponding to the amount obtained by subtracting twice the shift amount z from the gap tin the arrow B direction. From the state of part (c) of FIG. 11, the associated end of the elongated hole 213*a* is merely spaced from the shaft 214*a*, however, and the shift amount z is less than the sum of the left and right gaps t (twice the gap t) of the projection portion 214*a*, and, therefore, the projection portion 214*a*. For this reason, the opening amount of the F-side exhaust port 116*b* is kept unchanged at x−z.

By the above-described operation, even when the side end positions of the recording material P shift in the widthwise direction from the reference positions at which the recording material P should be originally located, the positions of the exhaust ports 116*b* and 116*c* can be changed so that opening regions of the exhaust ports 116*b* and 116*c* control with end portion regions of the fixing member deviated from the reference positions of the recording material P. That is, the outside air sent from the cooling fan 101 can be blown to the both end regions deviated from the (original) widthwise regions of the recording material P on the heating unit 21, so that only necessary portions can be cooled.

As described above, in the above-described embodiments, even in the case in which widthwise centers of the recording materials do not coincide with each other when the recording materials pass through the fixing device, the non-sheet-passing portion temperature rise can be properly prevented irrespective of the size of the recording material. Further, deterioration of the fixing property on a side the widthwise center of the recording material is deviated is suppressed, so that temperature rise in a region through which the recording material does not pass in the fixing member can be suppressed with reliability. Further, a lowering in fixing property is prevented, so that productivity can be maintained.

Modified Embodiments

In the above-described embodiments, preferred embodiments of the present invention were described, but the present invention is not limited thereto, and can be variously modified within the scope of the present invention.

Modified Embodiment 1

In the above-described embodiments, shown in FIG. 3, the linear image pick-up elements R1 and R2, each having a short widthwise length, were separately provided, but a single long image pick-up element may also be used. In this case, not only the shift amount (deviation amount) of the recording material with respect to the widthwise direction, but also the size of the recording material with respect to the widthwise direction can be detected.

Modified Embodiment 2

In the above-described embodiments, the fixing device using the heating roller and the pressing roller as the first and second fixing members for forming the nip in which the recording material carrying the toner image thereon is nipped and fed was described, but the present invention is not limited thereto. A fixing device of a film heating type in which an endless belt for rotating one or both of the first and second fixing members may also be used.

Modified Embodiment 3

In the above-described embodiments, recording paper (sheet) was described as the recording material, but the recording material in the present invention is not limited to the paper (sheet). In general, the recording material is a sheet-like member on which the toner image is formed by the image forming apparatus and includes, for example, regular-shaped or irregular-shaped recording materials, such as plain paper, thick paper, thin paper, an envelope, a postcard, a seal, a resin sheet, an overhead projector (OHP) sheet, and glossy paper. Incidentally, in the above-described embodiments, for convenience, handling of the recording material P (sheet) was described using terms such as sheet passing, but by this description, the recording material in the present invention is not limited to the paper.

Modified Embodiment 4

In the above-described embodiments, the fixing device for fixing the unfixed toner image on the sheet was described as an example, but the present invention is not limited thereto. The present invention is also similarly applicable to a device for heating and pressing a toner image temporarily fixed on the sheet (also in this case, the device is referred to as the fixing device).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

(A) an image forming portion configured to form toner images on recording materials; and (B) a fixing unit configured to form a nip, in which a toner image is fixed by nipping and feeding a recording material, wherein said fixing unit is capable of fixing the toner image on the recording material, said fixing unit including:

(a) an elongated heater extending in a longitudinal direction of said heater, the longitudinal direction of said heater being perpendicular to a feeding direction of the recording material;

(b) an air blowing device configured to blow air toward one end portion and another end portion of said heater, with respect to the longitudinal direction, when the recording material, having a size, with respect to the longitudinal direction, that is smaller than a maximum size of the recording material that can be fixed by said fixing unit, is inserted into said fixing unit;

(c) a first opening through which air blown from said air blowing device toward the one end portion of said heater passes;

(d) a first shielding member configured to change an opening width of said first opening with respect to the longitudinal direction;

(e) a second opening through which air blown from said air blowing device toward the other end portion of said heater passes;

(f) a second shielding member configured to change an opening width of said second opening with respect to the longitudinal direction;

(g) a detector configured to acquire position information relating to a position of an end portion of the recording material in the longitudinal direction, and to output the position information; and (h) a controller configured to make the opening widths of said first opening and said second opening correspond to widths of non-passing portions of the recording material in the nip by setting a moving amount of said first shielding member in the longitudinal direction and a moving amount of said second shielding member in the longitudinal direction on the basis of a deviation amount of the end portion of the recording material obtained from the position information output by said detector when the recording material, having a size other than the maximum size, is inserted into said fixing unit, the moving amount of said first shielding member in the longitudinal direction and the moving amount of said second shielding member in the longitudinal direction being different from each other.

2. The image forming apparatus according to claim 1, wherein said fixing unit further includes (i) a common driving source configured to move said first shielding member and said second shielding member, wherein said first shielding member includes a first shielding portion configured to shield said first opening, said first shielding portion being fixed to a first driven portion configured to receive a drive force from said common driving source, and wherein said second shielding member includes a second shielding portion configured to shield said second opening, said second shielding portion being movable by a predetermined amount in a movement direction relative to a second driven portion configured to receive the drive force from said common driving source.

3. The image forming apparatus according to claim 2, wherein said first driven portion and said first shielding portion are configured to move independently of each other in the longitudinal direction, wherein one of said second driven portion and said second shielding portion is provided with an elongated hole extending in the longitudinal direction, and wherein the other of said second driven portion and said second shielding portion is provided with a projection inserted in the elongated hole so as to be movable inside the elongated hole with respect to the longitudinal direction.

4. The image forming apparatus according to claim 1, wherein said fixing unit further includes:

(i) a first driving source configured to change the opening width of said first opening with respect to the longitudinal direction; and (j) a second driving source different from said first driving source, and configured to change the opening width of said second driving source with respect to the longitudinal direction.

5. The image forming apparatus according to claim 1, wherein the position information is temperature information of the one end portion and the other end portion of said heater.

6. The image forming apparatus according to claim 5, wherein said controller is configured to make the opening widths of said first opening and said second opening correspond to widths of non-passing portions of the recording material in the nip by making a moving amount of said first shielding member in the longitudinal direction and a moving amount of said second shielding member in the longitudinal direction different, on the basis of the deviation amount obtained from the position information output by said detector and size information of the recording material, when the recording material, having a size other than the maximum size, is inserted into said fixing unit.

7. An image forming apparatus comprising:

(A) an image forming portion configured to form toner images on recording materials; and (B) a fixing unit configured to form a nip, in which a toner image is fixed by nipping and feeding a recording material, wherein said fixing unit is capable of fixing the toner image on the recording material, said fixing unit including:

(a) an elongated heater extending in a longitudinal direction of said heater, the longitudinal direction of said heater being perpendicular to a feeding direction of the recording material;

(b) an air blowing device configured to blow air toward one end portion and another end portion of said heater with respect to the longitudinal direction when the recording material, having a size, with respect to the longitudinal direction, that is smaller than a maximum size of the recording material that can be fixed by said fixing unit, is inserted into said fixing unit;

(c) a first opening through which air blown from said air blowing device toward the one end portion of said heater passes;

(d) a first shielding member configured to change an opening width of said first opening with respect to the longitudinal direction;

(e) a second opening through which air blown from said air blowing device toward the other end portion of said heater passes;

(f) a second shielding member configured to change an opening width of said second opening with respect to the longitudinal direction;

(g) a first driving source configured to change the opening width of said first opening with respect to the longitudinal direction;

(h) a second driving source different from said first driving source, and configured to change the opening width of said second opening with respect to the longitudinal direction;

(i) a detector configured to detect temperatures of the one end portion and the other end portion of said heater; and (j) a controller configured to control, on the basis of an output of said detector and size information of the recording material, the opening widths of said first opening and said second opening, so as to correspond to widths of non-passing portions of the recording material in the nip, by moving said first shielding member and said second shielding member in the longitudinal direction, respectively, when the recording material other than the maximum size is inserted into said fixing unit.

8. The image forming apparatus according to claim 7, wherein said detector detects the temperatures of the one end portion and the other end portion of said heater, with respect to the longitudinal direction, when the recording material passes through the nip, and wherein said controller controls the opening widths of said first opening and said second opening, so as to be different from each other, by moving said first shielding member and said second shielding member, respectively, on the basis of a difference between each of the one end portion and the other end portion of said heater and a value stored in said controller in advance depending on the size information of the recording material.

9. A fixing device for fixing toner images on recording materials in a nip by nipping and feeding the recording materials in the nip, said fixing device comprising:

an elongated heater extending in a longitudinal direction of said heater of said heater, the longitudinal direction of said heater being perpendicular to a feeding direction of a recording material;

an air blowing device configured to blow air toward one end portion and another end portion of said heater, with respect to the longitudinal direction, when the recording material, having a size, with respect to the longitudinal direction, that is smaller than a maximum size of the recording material that can be fixed by said fixing device, is inserted into said fixing device;

a first opening through which air blown from said air blowing device toward the one end portion of said heater passes;

a first shielding member configured to change an opening width of said first opening with respect to the longitudinal direction;

a second opening through which air blown from said air blowing device toward the other end portion of said heater passes;

a second shielding member configured to change an opening width of said second opening with respect to the longitudinal direction;

a detector configured to acquire position information relating to a position of an end portion of the recording material in the longitudinal direction, and to output the position information; and a controller configured to make the opening widths of said first opening and said second opening correspond to widths of non-passing portions of the recording material in the nip by setting a moving amount of said first shielding member in the longitudinal direction and a moving amount of said second shielding member in the longitudinal direction on the basis of a deviation amount of the end portion of the recording material obtained from the position information output by said detector when the recording material having a size other than the maximum size is inserted into said fixing device, the moving amount of said first shielding member in the longitudinal direction and the moving amount of said second shielding member in the longitudinal direction being different from each other.

10. The fixing device according to claim 9, further comprising a common driving source configured to move said first shielding member and said second shielding member, wherein said first shielding member includes a first shielding portion configured to shield said first opening, said first shielding portion being fixed to a first driven portion configured to receive a drive force from said common driving source, and wherein said second shielding member includes a second shielding portion configured to shield said second opening, said second shielding portion being movable by a predetermined amount in a movement direction relative to a second driven portion configured to receive the drive force from said common driving source.

11. The fixing device according to claim 10, wherein said first driven portion and said first shielding portion are configured to move independently of each other in the longitudinal direction, wherein one of said second driven portion and said second shielding portion is provided with an elongated hole extending in the longitudinal direction, and wherein the other of said second driven portion and said second shielding portion is provided with a projection inserted in the elongated hole so as to be movable inside the elongated hole with respect to the longitudinal direction.

12. The fixing device according to claim 9, further comprising:

a first driving source configured to change the opening width of said first opening with respect to the longitudinal direction; and a second driving source different from said first driving source, and configured to change the opening width of said second driving source with respect to the longitudinal direction.

13. The fixing device according to claim 9, wherein the position information is temperature information of the one end portion and the other end portion of said heater.

14. The fixing device according to claim 13, wherein said controller is configured to make the opening widths of said first opening and said second opening correspond to widths of non-passing portions of the recording material in the nip by making a moving amount of said first shielding member in the longitudinal direction and a moving amount of said second shielding member in the longitudinal direction different, on the basis of the deviation amount obtained from the position information output by said detector and size information of the recording material, when the recording material, having a size other than the maximum size, is inserted into said fixing device.

15. The fixing device according to claim 9, further comprising a cylindrical film configured to be heated by said heater.

16. The fixing device according to claim 15, wherein said heater is in contact with an inner surface of said film.

17. The fixing device according to claim 16, further comprising a roller configured to form a nip portion for nipping and conveying the recording material in cooperation with said heater through said film.

18. The fixing device according to claim 17, wherein said heater is provided in an inner space of said film, and wherein said roller configured to form the nip portion in cooperation with said heater through said film.

19. A fixing device for fixing toner images on recording materials in a nip by nipping and feeding the recording materials in the nip, said fixing device comprising:

an elongated heater extending in a longitudinal direction of said heater, the longitudinal direction of said heater being perpendicular to a feeding direction of a recording material;

an air blowing device configured to blow air toward one end portion and another end portion of said heater, with respect to the longitudinal direction, when the recording material, having a size, with respect to the longitudinal direction, that is smaller than a maximum size of the recording material that can be fixed by said fixing device, is inserted into said fixing device;

a first opening through which air blown from said air blowing device toward the one end portion of said heater passes;

a first shielding member configured to change an opening width of said first opening with respect to the longitudinal direction;

a second opening through which air blown from said air blowing device toward the other end portion of said heater passes;

a second shielding member configured to change an opening width of said second opening with respect to the longitudinal direction;

a first driving source configured to change the opening width of said first opening with respect to the longitudinal direction;

a second driving source different from said first driving source, and configured to change the opening width of said second opening with respect to the longitudinal direction;

a detector configured to detect temperatures of the one end portion and the other end portion of said heater; and a controller configured to control, on the basis of an output of said detector and size information of the recording material, the opening widths of said first opening and said second opening, wherein, when the recording material having a size other than the maximum size is inserted into said fixing device, said controller makes the opening widths of said first opening and said second opening correspond to widths of non-passing portions of the recording material in the nip by moving said first shielding member and said second shielding member in the longitudinal direction, respectively, on the basis of the output of said detector and the size information of the recording material.

20. The fixing device according to claim 19, wherein said detector detects the temperatures of the one end portion and the other end portion of said heater, with respect to the longitudinal direction, when the recording material passes through the nip, and wherein said controller controls the opening widths of said first opening and said second opening, so as to be different from each other, by moving said first shielding member and said second shielding member, respectively, on the basis of a difference between each of the one end portion and the other end portion of said heater and a value stored in said controller in advance depending on the size information of the recording material.

* * * * *